US007976021B2

(12) United States Patent
Matsuo

(10) Patent No.: US 7,976,021 B2
(45) Date of Patent: Jul. 12, 2011

(54) SHEET DISCHARGE DEVICE AND IMAGE FORMING APPARATUS

(75) Inventor: Takeshi Matsuo, Osaka (JP)

(73) Assignee: Kyocera Mita Corporation (JP)

( * ) Notice: Subject to any disclaimer, the term of this patent is extended or adjusted under 35 U.S.C. 154(b) by 49 days.

(21) Appl. No.: 12/497,942

(22) Filed: Jul. 6, 2009

(65) Prior Publication Data

US 2010/0001462 A1 Jan. 7, 2010

(30) Foreign Application Priority Data

Jul. 4, 2008 (JP) ..... 2008-175949

(51) Int. Cl.
*B65H 39/10* (2006.01)

(52) U.S. Cl. ..... 271/305; 271/297; 271/303

(58) Field of Classification Search ..... 271/297, 271/305, 303, 287
See application file for complete search history.

(56) References Cited

U.S. PATENT DOCUMENTS

| | | | | |
|---|---|---|---|---|
| 4,015,841 | A * | 4/1977 | Mitsumasu | 271/297 |
| 4,299,382 | A * | 11/1981 | Ichikawa | 271/287 |
| 4,349,190 | A * | 9/1982 | Kaneko et al. | 271/297 |
| 4,352,490 | A * | 10/1982 | Hatakeyama | 271/289 |
| 4,469,323 | A * | 9/1984 | Miyashita et al. | 271/288 |
| 4,819,931 | A * | 4/1989 | Goto et al. | 271/287 |
| 4,998,716 | A * | 3/1991 | Okumura et al. | 271/297 |
| 5,104,117 | A * | 4/1992 | McCormick et al. | 271/297 |
| 5,346,205 | A * | 9/1994 | Lawrence | 271/297 |
| 5,348,288 | A * | 9/1994 | Coombs et al. | 271/288 |
| 5,938,194 | A * | 8/1999 | Coombs et al. | 271/297 |
| 6,308,952 | B1 * | 10/2001 | Takagi et al. | 271/297 |
| 6,478,298 | B1 | 11/2002 | Mandel | |

FOREIGN PATENT DOCUMENTS

| | | |
|---|---|---|
| JP | 4-308865 | 10/1992 |
| JP | 2002-137866 | 5/2002 |

* cited by examiner

*Primary Examiner* — Stefanos Karmis
*Assistant Examiner* — Luis A Gonzalez
(74) *Attorney, Agent, or Firm* — Gerald E. Hespos; Michael J. Porco

(57) ABSTRACT

A sheet discharge device includes: a sheet discharge path for discharging a sheet to be discharged; a plurality of sheet discharge trays disposed along the sheet discharge path; a plurality of switching guides disposed in the sheet discharge path corresponding to the sheet discharge trays, and being changed a position between a retracting position for being retracted so that the sheet being conveyed can pass through, and a distributing position for distributing a sheet being conveyed to the sheet discharge tray; and a switching mechanism which changes the position of the switching guide between the retracting position and the distributing position. This switching mechanism includes: a switching piece which interferes with the switching guide to switch the position of the switching guide, one transporting member which moves the switching piece among the plurality of switching guides, and a drive member driving the transporting member.

20 Claims, 12 Drawing Sheets

SHEET DISCHARGE DEVICE AND IMAGE FORMING APPARATUS

BACKGROUND OF THE INVENTION

1. Field of the Invention

The present invention relates to a sheet discharge device having a plurality of levels of sheet discharge trays, that is, a multi-tray device, and an image forming apparatus in which this sheet discharge device is applied.

2. Description of the Related Art

An image forming apparatus performs a predetermined image formation processing based on image information acquired by reading an original image or one transferred from the outside, and then performs print processing on paper (sheet) according to this image information. Paper on which print processing is performed is immediately discharged, or is discharged after post-processing, such as punching processing and stapling processing.

Some image forming apparatus have a multi-tray device, in which a plurality of paper discharge trays are installed in vertical parallel positions as paper discharge destinations. In an image forming apparatus having a multi-tray device, discharge paper conveying paths are provided along the edge of each paper discharge tray in the vertical direction.

Japanese Patent Application Laid-Open No. H4-308865, for example, discloses a multi-tray device in which switching guides (distribution guides) for switching the paper conveying destination between the paper discharge path and the paper discharge tray, and solenoid devices for changing the orientation of each switching guide, are disposed on the paper discharge path at a position facing each paper discharge tray. In such a multi-tray device, however, the solenoid device must be installed for each of the plurality of paper discharge trays, which increases the number of components and therefore increases component cost.

To solve this problem, Japanese Patent Application Laid-Open No. 2002-137866 discloses a multi-tray apparatus in which a gate is disposed in each paper discharge path, without disposing the respective switching guide and solenoid device in the plurality of paper discharge trays. This gate is rotatably supported with the rotation support point formed on a wall surface on one side of the paper discharge path, and the top edge thereof contacts the wall surface on the other side of the paper discharge path by the biasing force of the biasing means. When paper ascends the paper discharge path, the paper moves while opening a gate by the ascending operation, and when paper descends, the paper is always received by a gate and discharged to a paper discharge tray corresponding to this gate. In this device, a paper discharge tray at the paper discharge destination is selected in advance, and immediately after the rear end of paper passes through the gate corresponding to the selected paper discharge tray, this paper is conveyed in reverse. Thereby the paper is discharged and guided to the gate, and discharged to the target paper discharge tray.

However, in the case of a multi-tray device that requires the reverse conveying of paper, paper is unnecessarily conveyed in the forward direction until the rear end of the paper passes through the gate for the selected paper discharge tray, and then is reversed and discharged to the paper discharge tray. As a consequence, it takes an unnecessary amount of time to discharge the paper, for the amount of extra forward conveying and reverse conveying, and paper discharge efficiency is not good.

SUMMARY OF THE INVENTION

It is an object of the present invention to provide a sheet discharge device having a multi-tray device in which sheet discharge efficiency is improved, while guaranteeing the discharge of sheet to a selected sheet discharge tray.

A sheet discharge device according to an aspect of the present invention to achieve this object includes: a sheet discharge path for discharging a sheet to be discharged; a plurality of sheet discharge trays disposed along the sheet discharge path; a plurality of switching guides disposed in the sheet discharge path corresponding to the sheet discharge trays, and being changed a position between a retracting position for being retracted so that the sheet being conveyed can pass through, and a distributing position for distributing a sheet being conveyed to the sheet discharge tray; and a switching mechanism which changes the position of the switching guide between the retracting position and the distributing position. This switching mechanism includes: a switching piece which interferes with the switching guide to switch the position of the switching guide, one transporting member which moves the switching piece among the plurality of switching guides, and a drive member driving the transporting member.

An image forming apparatus according to another aspect of the present invention includes: an image forming unit which performs image forming processing on sheet, and a sheet discharge device discharging sheets on which an image has been formed, and this sheet discharge device has the above mentioned configuration.

DETAILED DESCRIPTION OF THE PREFERRED EMBODIMENTS

Figure 1:
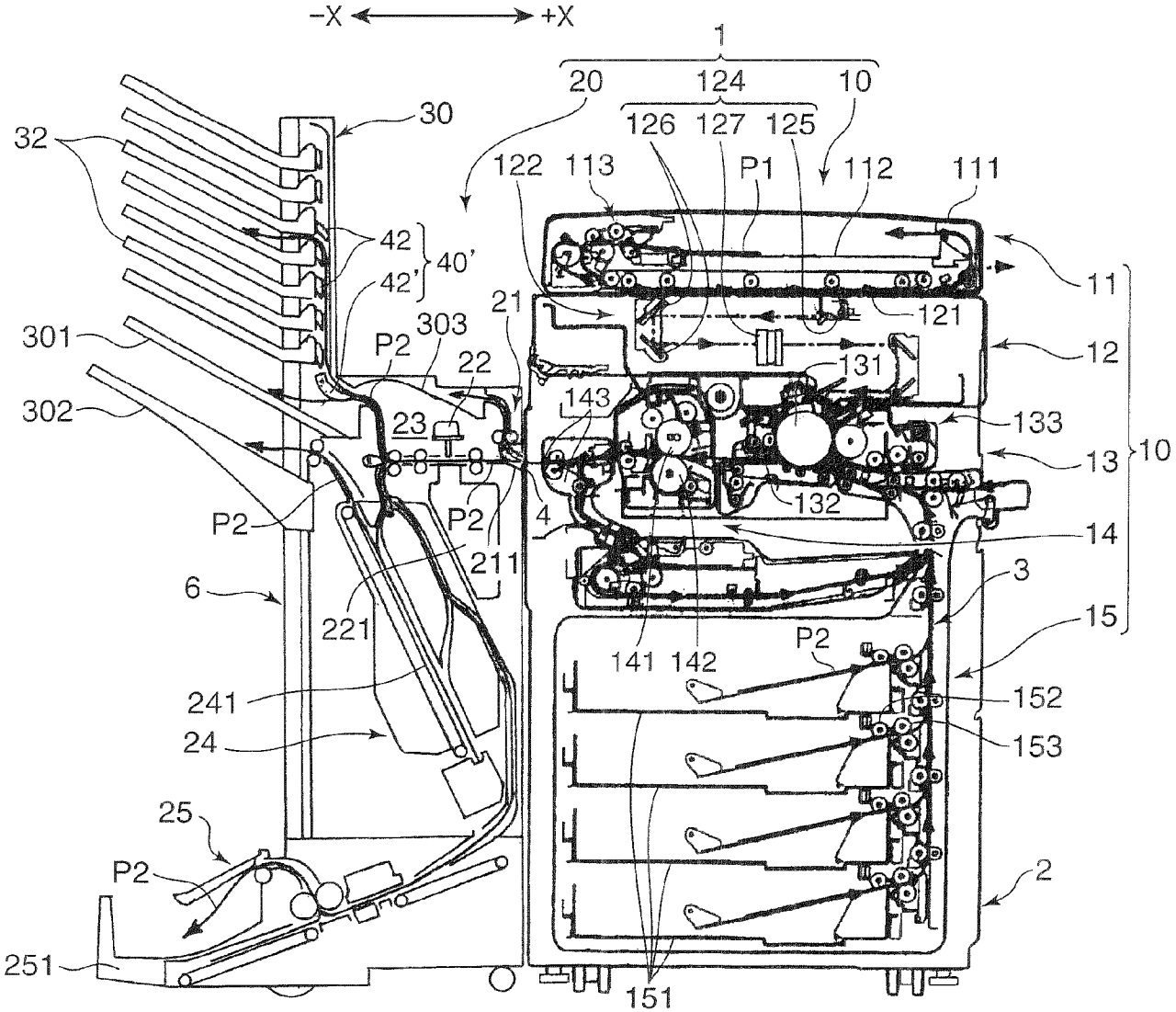
FIG. 1 is a front cross-sectional view depicting an embodiment of an image forming apparatus to which a paper discharge device according to the present invention is applied.

Examples when a paper (one kind of sheet) discharge unit according to the present invention is applied to an image forming apparatus will now be described. FIG. 1 is a front cross-sectional view depicting an image forming apparatus 1 according to the present embodiment. The X direction in FIG. 1 is defined as the horizontal direction, where −X is the left side and +X is the right side. As FIG. 1 shows, the image forming apparatus 1 includes a composite machine 10 which forms an image based on image information and transfers it to paper P2, and a post-processing apparatus 20 which performs post-processing on paper P2 for which the composite machine 10 performed print processing.

The composite machine 10 functions as a copier, which forms an image based on an original image of an original P1 which this machine has scanned, and transfers this image to paper P2, as a printer, which forms an image based on image information transferred from an external personal computer and transfers the image to paper P2, and as a facsimile, which forms an image based on image information transferred via a communication line and transfers the image to paper P2.

The composite machine 10 will be described first. The composite machine 10 has an original setting unit 11 for setting an original P1, an image reading unit 12 which optically reads the original image from the original P1 which is set in the original setting unit 11, an image formation unit 13 which transfers the original image, which was read by the image reading unit 12, to the paper P2 as a toner image, a fixing unit 14 which fixes the toner image transferred by the image formation unit 13 to paper, and a paper storage unit 15 which stores paper P2 to be fed to the image formation unit 13, which are installed in a box-shaped apparatus main body 2.

The image reading unit 12, image formation unit 13, fixing unit 14 and paper storage unit 15 are installed in the apparatus main body 2. The original setting unit 11, on the other hand, is installed on the top face of the apparatus main body 2, separate from the apparatus main body 2.

The original setting unit 11 has a cover unit 111 which can be opened/closed, an original tray 112 which is formed in a concave area on the top face of this cover unit 111, and an original feeding mechanism 113 which feeds each sheet of paper from a stack of original P1 being set in the original tray 112, and channels paper to the image reading unit 12 one sheet at a time, so that the original image faces the top face of the image reading unit 12.

The image reading unit 12 includes a contact glass 121 which is disposed on the top face of the image reading unit 12 and on which an image surface of the original P1 contacts, and an image reading mechanism 122 which scans and reads the original image contacting the contact glass 121. In the present embodiment, the image reading mechanism 122 has an optical system member 124, such as a moving light source 125, which irradiates light onto the original image while moving, a plurality of mirrors 126 which reflect the reflected light of the light from the moving light source 125 coming from the original image, so that the reflected light progresses along a predetermined optical path, and a lens member 127 which converges lights on the optical path.

The image formation unit 13 has a photosensitive drum 131 where an electrostatic latent image and tone image are sequentially formed on the circumferential surface, and a conveying belt 132 which feeds the paper P2 to the circumferential surface of the photosensitive drum 131. On the circumferential surface of the photosensitive drum 131, which is rotating about the axis center, scan light, which is acquired by scanning the original image of the original P1 and passed through the optical system member 124, is input to a CCD (Charge Coupled Device), analog signals corresponding to the image data are converted into digital signals, and laser beams corresponding to the digital signals are irradiated from a separately disposed exposure device to the circumferential surface of the photosensitive drum 131. By this irradiation, electrostatic latent images are sequentially formed on this circumferential surface, and at the same time, toner is supplied from the development unit 133 to the electrostatic latent image at the downstream side of the scan light irradiation position, thereby a toner image is formed on the circumferential surface of the photosensitive drum 131. This toner image is transferred to the paper P2 fed by the conveying belt 132.

The fixing unit 14 performs fixing processing on the toner image on the paper P2, where the image formation unit 13 transfers the image using the photosensitive drum 131, and has a fixing roller 141 which encloses a heating source, such as an electric heater element, and a pressure roller 142 which is disposed facing the fixing roller 141 from the bottom. The paper P2 conveyed from the image formation unit 13 by rotation of the conveying belt 132 is fed to a nip portion between the fixing roller 141 and the pressure roller 142, where the toner image is fixed to the paper P2 by receiving heat from the fixing roller 141. The paper P2 which passed through the fixing unit 14 is conveyed through the paper discharge outlet 4 to the post-processing apparatus 20, via a pair of feed out rollers 143, which is disposed at the most downstream end.

The paper storage unit 15 has a plurality of levels of paper cassettes 151 which are enclosed in the apparatus main body 2, and can be freely inserted and removed. In each paper cassette 151, a pickup roller 152 and paper feed roller 153 are installed on one edge (right edge in the example of FIG. 1). By the rotary driving of the pickup roller 152, paper on the top of the stack of the paper P2, being set in the paper cassette 151, is sequentially fed and conveyed to the image formation unit 13 via the paper feed roller 153 and the conveying path 3.

The paper P2, which is fed out from the paper cassette 151, is conveyed by the conveying belt 132, while the toner image on the circumferential surface of the photosensitive drum 131 is transferred thereon. The paper P2 on which the toner image is transferred is continuously heated by the fixing roller 141 in the fixing unit 14 during thermal fixing processing, is then discharged from the paper discharge outlet 4 of the apparatus main body 2 via the feed out roller 143, and is transferred to the post-processing apparatus 20.

Now the post-processing apparatus 20 will be described with reference to FIG. 1. The post-processing apparatus 20 has a box-shaped apparatus main body 6 and devices housed in the main body 6, which include a paper feed-in unit 21, a punch unit 22, a sorting unit 23, an intermediate tray unit 24, a later described multi-tray unit 30 and a centerfold unit 25.

The paper feed-in unit 21 is a portion to receive the paper P2 after the transfer processing, which is discharged from the paper discharge outlet 4 via the feed out roller pair 143 of the composite machine 10 into the post-processing apparatus 20. The paper feed-in unit 21 has a paper receive chute 211 which is an inclined plate.

The paper receive chute 211 is formed at the upper right portion of the apparatus main body 6 in FIG. 1, so as to vertically open toward the paper discharge outlet 4 of the composite machine 10. Therefore the paper P2, discharged from the paper discharge outlet 4, slides to the upper left direction by being guided along the vertical surface of the paper receive chute 211.

The punch unit 22 forms punch holes at the top edge (left side in FIG. 1) of the paper P2 fed from the composite machine 10 via the paper feed in unit 21. The punch unit 22 has a punching machine, a pedestal which is disposed directly under the punching machine sandwiching the conveying path of the paper P2, and a punch refuse container 221 for containing punch refuse which is disposed directly under the pedestal. When paper P2 to be punched is fed into the post-processing unit 20 from the composite machine 10 via the paper discharge outlet 4, punch unit 22 executes punching processing on the front edge of the paper P2 using the punching machine, and the paper P2 is continuously conveyed to the sorting unit 23. The punch refuse generated at this time is stored in the punch refuse container 221. If the paper P2 which is not punched is fed into the post-processing unit 20 from the composite machine 10, the paper P2 passes through the punch unit 22 without punching processing being executed.

The sorting unit 23 is a portion to sort the paper P2 which passed through the punch unit 22 according to destination of the paper P2, that is, the general purpose tray 301, multi-tray unit 30, and intermediate tray unit 24. The destination of the paper P2 is predetermined automatically according to the type of paper processing, or by a predetermined setting operation which the user performs via the operation panel.

The intermediate tray unit 24 is a portion to perform such post-processing as staple processing on the conveyed paper P2. A predetermined number of sheets of paper conveyed into the intermediate tray unit 24, is stacked in the intermediate conveying path 241, and after a predetermined staple processing is performed by the stapler, the paper is conveyed in reverse and discharged to a large capacity tray 302. The large capacity tray 302 can be ascended/descended so that large stacking paper can be discharged, and the height position thereof can be controlled according to the volume of the stack.

According to the present embodiment, a top face tray 303 which simply discharges paper P2 fed from the composite machine 10 to the post-processing apparatus 20, without performing the punching processing and staple processing, is disposed on the top face of the apparatus main body 6. Normally A4 sized paper P2 is discharged to this top face tray 303. A3 sized paper P2, on the other hand, is discharged to the general purpose tray 301.

The centerfold unit 25 is a portion which has a stapler for saddle stitching and folding the paper P2 in two after staple processing is performed with a stapler for saddle stitching (centerfold processing). The centerfold target paper P2 is conveyed to the centerfold unit 25 via the intermediate conveying path 241 of the intermediate tray unit 24, and predetermined centerfold processing is performed. The paper P2, after centerfold processing, is discharged to a dedicated centerfold tray 251.

The image forming apparatus 1 has an interface circuit to exchange information with the printer or facsimile device when the composite machine 10 is used as a printer or facsimile device, but the description thereof is omitted here.

Figure 2:
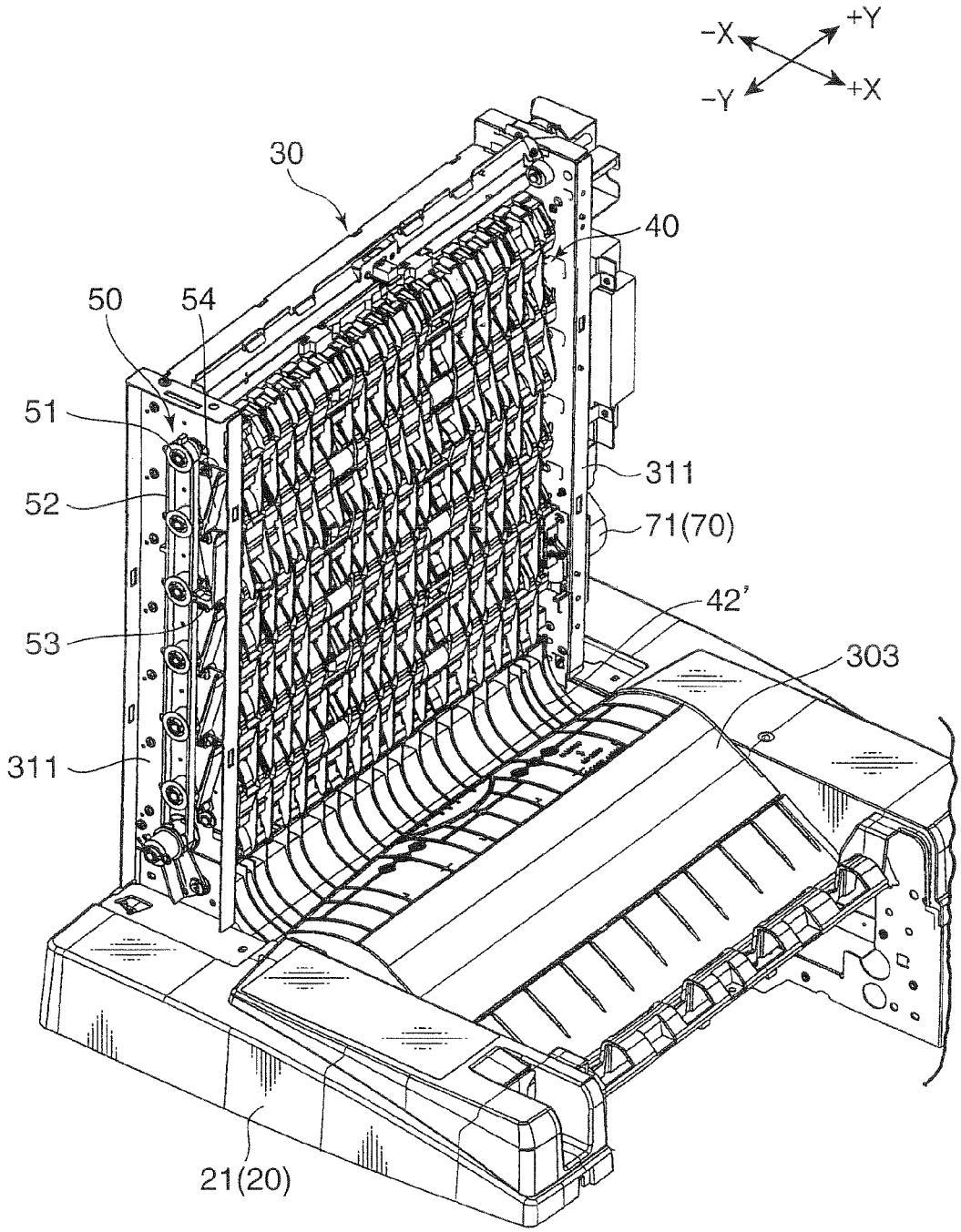
FIG. 2 is a perspective skeleton diagram depicting a multi-tray unit according to the present embodiment.
Figure 3:
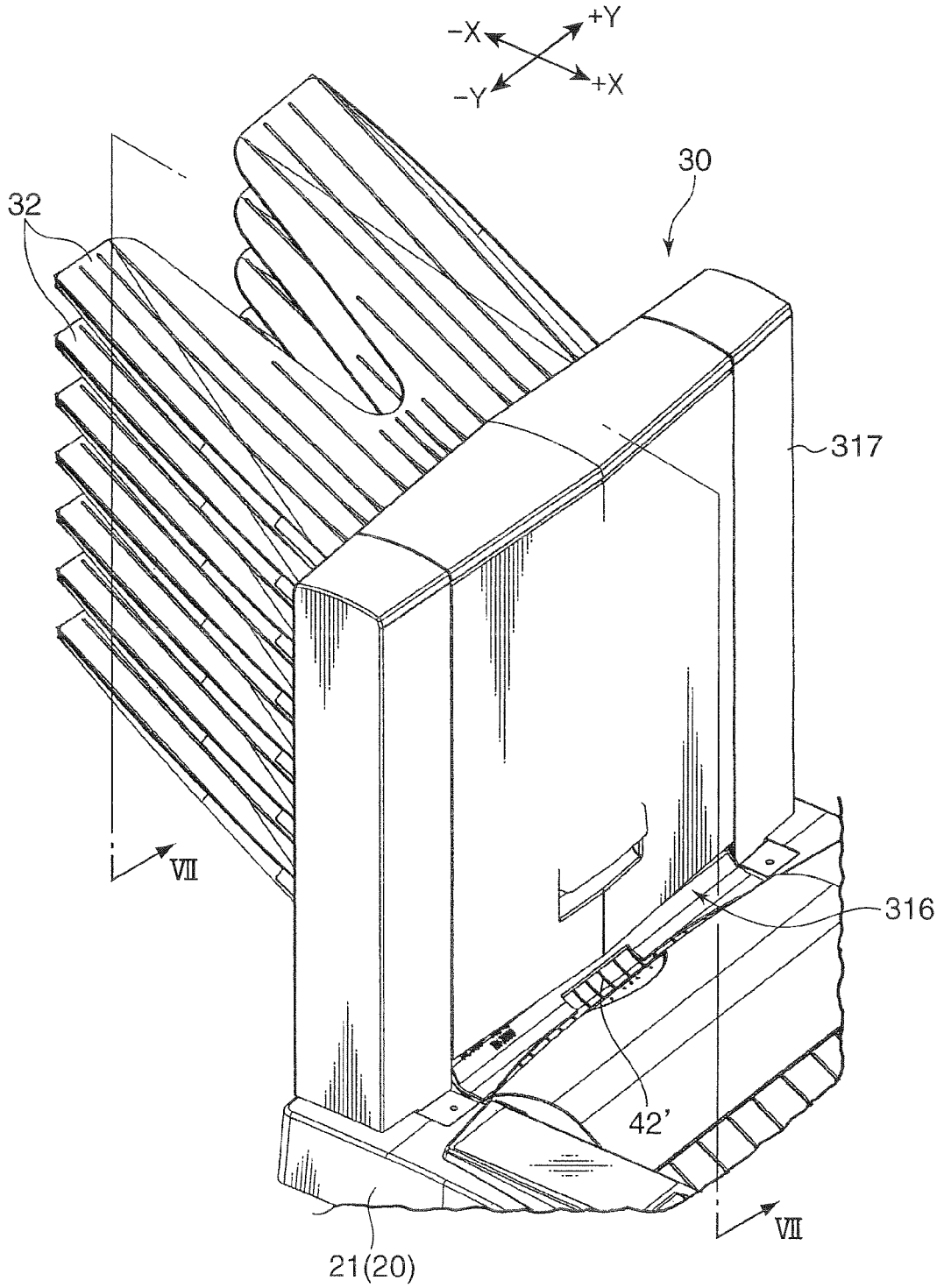
FIG. 3 is a perspective view depicting a state when a cover and paper discharge tray are attached to the skeleton in FIG. 2.
Figure 4:
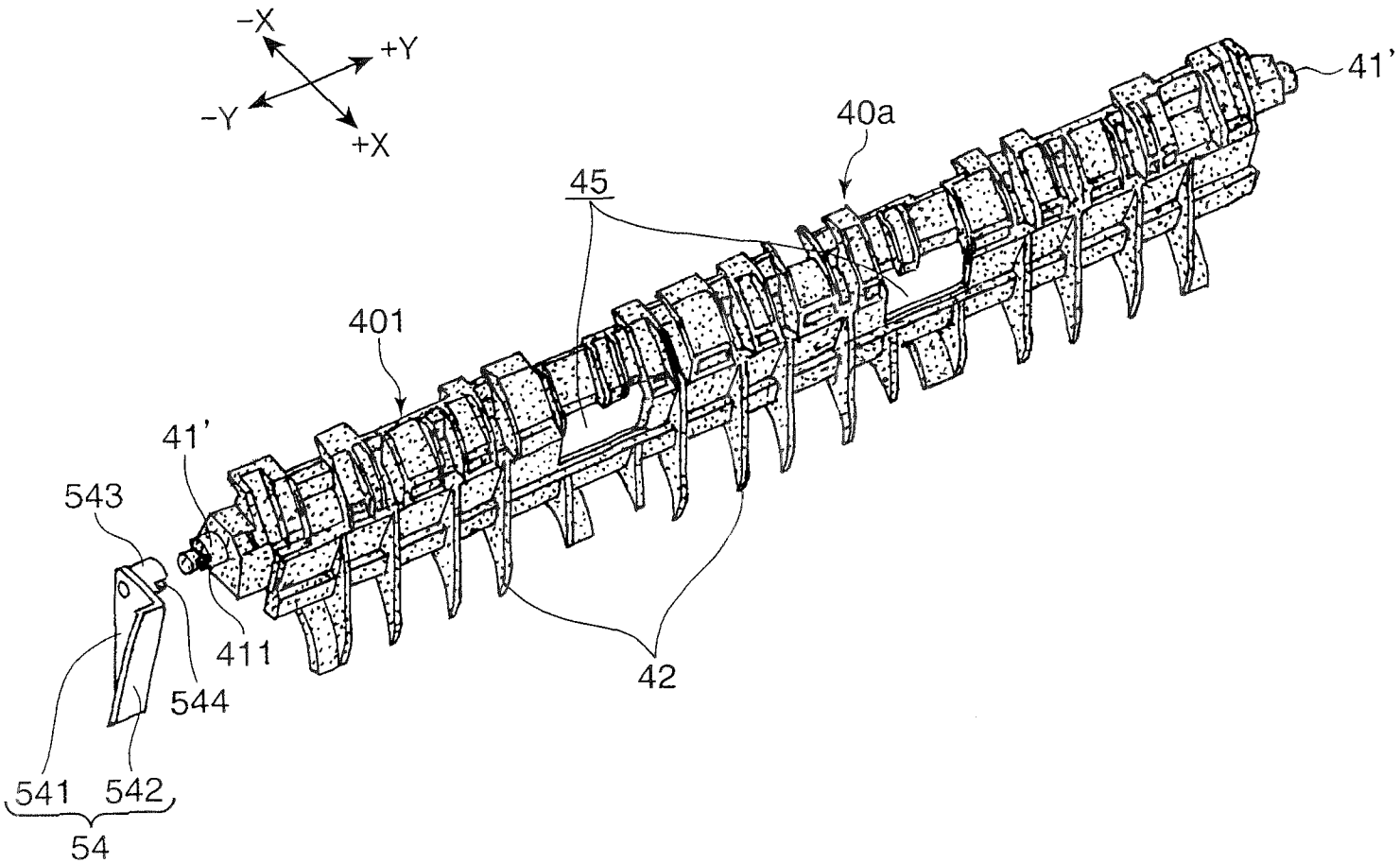
FIG. 4 is a perspective view depicting an embodiment of a switching guide.
Figure 5:
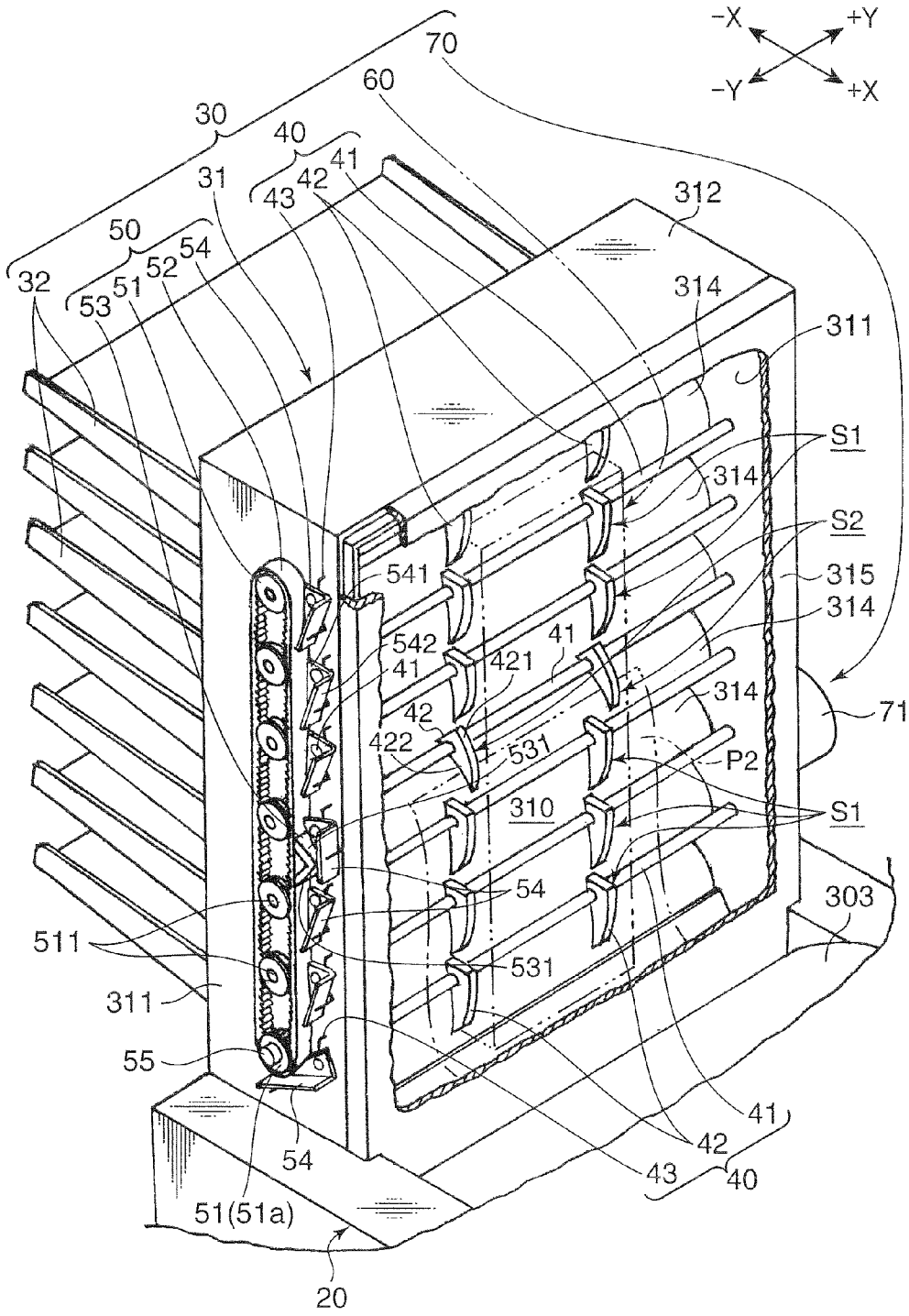
FIG. 5 is a partially cut away perspective view for explaining a principle of the multi-tray unit, which is a perspective view viewed from the front.
Figure 6:
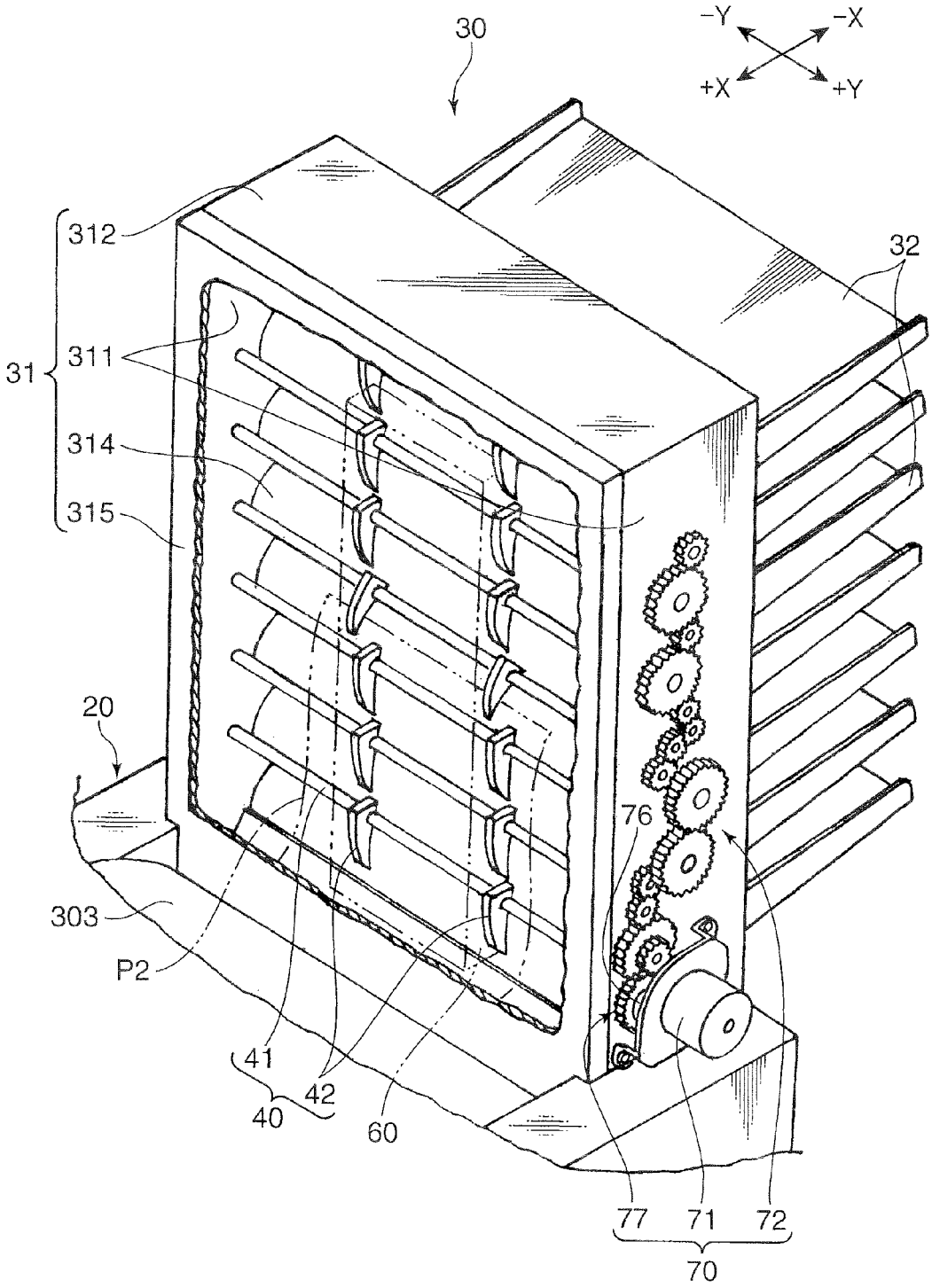
FIG. 6 is a perspective view depicting the multi-tray unit in FIG. 5 viewed from the back.

Now the multi-tray unit 30 (a plurality of paper discharge trays) will be described with reference to FIG. 2 to FIG. 6. FIG. 2 is a perspective skeleton diagram of the multi-tray unit 30, FIG. 3 is a perspective view depicting the state when a cover 317 and a paper discharge tray 32 are attached to the skeleton in FIG. 2, and FIG. 4 is a perspective view depicting an embodiment of the switching guide 40. FIG. 5 and FIG. 6 are partially cutaway perspective views for explaining the principle of the multi-tray unit 30 shown in FIG. 2 to FIG. 4. FIG. 5 is a perspective view from the front, and FIG. 6 is a perspective view viewed from the back. In FIG. 2 to FIG. 6, the X direction is the left and right, and the Y direction is the front and back, where −X is left, +X is right, −Y is front and +Y is back.

Now the multi-tray unit 30 according to the present embodiment will be described based on FIG. 5 and FIG. 6, which are diagrams explaining a principle, with reference to FIG. 2 to FIG. 4 when necessary. In FIG. 5, the number of guide fins 42 attached to each guide shaft 41 of the switching guide 40 is 2, which is less than the actual number, and only the location of the conveying mechanism 60 is shown by a two-dot chain line, and the drive force transfer mechanism 70 is shown only as a drive motor 71 (drive member) which is a composing element thereof, in order to simplify the illustration.

The multi-tray unit 30 has a rectangular frame 31 which is long in the vertical direction and flat in the left and right directions, a plurality of paper discharge trays 32 which protrude from this frame 31 to the left, and are disposed with an equal pitch in the vertical direction, a plurality of switching guides 40 which are disposed in the frame 31 corresponding to each of the paper discharge trays 32, a position change mechanism 50 (switching mechanism) which changes the position of each switching guide 40, a conveying mechanism 60 which conveys paper P2 in the frame 31, and a drive force transfer mechanism 70 which is installed outside the frame 31 to transfer the drive force to the position change mechanism 50 and the conveying mechanism 60.

The frame 31 stands at the left side on the top surface of the apparatus main body 6 of the post-processing apparatus 20. The frame 31 has a pair of side plates 311 disposed in the front and back directions, a top plate 312 which is installed between the top edges of the pair of side plates 311, a plurality of guide plates 314 in the frame which are installed between the pair of side plates 311, corresponding to each of the paper discharge trays 32, and a right plate 315 installed between the pair of side plates 311 so as to cover the entire opening of the frame 31 at the right side. A plurality of ribs which extend in the vertical direction, and driven rollers (later mentioned second conveying rollers 612 (FIG. 7)), are disposed on the back side (left side) of the right plate 315, so as to form a paper discharge path 310 (sheet discharge path; vertical conveying path). These enable the smooth conveying of the paper P2 which ascends along the paper discharge path 310.

The right plate 315 can be opened by turning about a predetermined axis, which is formed on top and extends in the front and back directions (not illustrated). By opening this right plate 315, the maintenance operation and jamming clearing operation can be performed.

The paper discharge path 310 is disposed between the right plate 315 and the switching guides 40, and extends in the vertical direction for conveying the paper P2 upward. When the position of a switching guide 40 changes, the paper P2, ascending along the paper discharge path 310, is discharged to the paper discharge tray 32, corresponding to the changed switching guide 40.

The seven levels of paper discharge trays 32 are installed in the vertical direction in the present embodiment, but the number of levels of the paper discharge trays 32 is not limited to seven. These paper discharge trays 32, of which bases are secured to each side plate 311 at the left of the frame 31, protrude to the left side, slightly tilted upward.

The switching guides 40 have a plurality of (seven in the present embodiment) guide shafts 41, which are installed between the pair of side plates 311 with an equal pitch in the vertical direction, a plurality of guide fins 42 secured in each guide shaft 41, and a torsion bar spring 43 (biasing member) for securing each switching guide 40 to be set in a predetermined position (later mentioned retracting position S1). Two guide fins 42 are shown in FIG. 5 and FIG. 6 to simplify the illustration, but many guide fins actually exist, as shown in FIG. 2 and FIG. 4.

The guide fin 42 has a crescent shape viewed from the side, and the right edge thereof has a convex arc edge 421, which is convex at the right side, and the left edge thereof has a concave arc edge 422, which is concave at the left side. A guide fin 42, where the guide shaft 41 penetrates at the upper left corner, is secured to this guide shaft 41.

The switching guide 40 can switch positions between the retracting position S1, where the guide fins 42 hang down, thereby the paper P2, which is fed into the paper discharge path 310 from the bottom, is allowed to pass through, and the distributing position S2, where the paper P2 to the paper discharge tray 32 along the concave arc edge portion 422. In the retracting position S1, the paper P2, being conveyed upward along the paper discharge path 310, is allowed to pass along the convex arc edge portion 421. The retracting position S1 is changed to the distributing position S2 when the guide fins turns counterclockwise about the guide shaft 41. In the distributing position S2, the convex arc edge portion 421 contacts the right plate 315, and the paper P2 is guided to the paper discharge tray 32 along the concave arc edge portion 422.

The switching guide 40 described above is a simplified guide, as shown in FIG. 5 and FIG. 6, but a switching guide that is actually used is integrally manufactured with hard synthetic resin material by an injection molding method. FIG. 4 shows an example of the actual switching guide 40*a*. The actual switching guide 40*a* includes a guide main body 401 which is long in the front and back directions, a plurality of (16 in the case of the example in FIG. 4) guide fins 42 protruding from the guide main body 401, two release holes 45 for installing a third conveying roller 621 of a later mentioned discharge conveying mechanism 62 (see FIG. 7), and concave portions are created at each location to lighten the weight of the guide.

The switching guide 40 shown in FIG. 5 has an extremely simple structure, where the guide fins 42 are externally inserted into the guide shaft 41 so as to rotate integrally, but in reality the guide shaft 41' is formed by columnar protrusions which protrude concentrically from the front and back edges of the guide main body 401, as shown in the guide 40*a* in FIG. 4.

An engaging protrusion 411, which protrudes out from the circumferential surface in the diameter direction, is disposed on the front portion of the guide shaft 41', and a connecting tube 543, which externally fits into the guide shaft 41', is disposed on a triangular plate 541 of the operation member 54. An engaging slot 544, which externally inserts into the engaging protrusion 411, is disposed on this connecting tube 543. The operation member 54 is installed so that the engaging slot 544 fits with the engaging protrusion 411 penetrating the side plate 311 in the front. Thereby the operation member 54 can rotate integrally about the guide shaft 41'.

Referring back to FIG. 5, the position change mechanism 50 has a plurality of pulleys 51 which are supported so as to rotate about the protruding shaft 511, which protrudes out from the side plate 311 in the front corresponding to the third roller shaft 623 of the later mentioned discharge conveying mechanism 62, a timing belt 52 (one transporting member: endless belt) which is wound around each pulley 51, an interference protrusion 53 secured on the outer surface side of the timing belt 52 (switching piece), and an operation member 54 (first engaging unit) which is installed on each guide shaft 41, penetrating the side plate 311 in the front so as to rotate integrally.

Out of a plurality of (seven in the present embodiment) pulleys 51, the lowest pulley is a synchronous pulley 51*a* which has teeth on the circumferential surface so as to engage the timing belt 52. The timing belt 52 is installed between the synchronous pulley 51*a* and the highest pulley 51. The synchronous pulley 51*a* externally inserts concentrically into the shaft 55 (FIG. 11), which is installed penetrating the side plates 311 in the front and back, so as to rotate integrally. If the installation shaft 55 is rotated and driven by the drive motor 71, this rotation drive is accurately transferred to the timing belt 52 via the synchronous pulley 51*a*. The timing belt 52 rotates clockwise when viewed from the front.

The pulley 51 (second pulley), other than the synchronous pulley 51*a* (first pulley), is for preventing the slip of the timing belt 52 to the left side by being pressed by the operation member 54 when the interference protrusion 53 interferes with the operation member 54. Therefore a synchronous pulley is not used.

The interference protrusion 53 interferes with the operation member 54 by the rotation of the timing belt 52, so as to change the position of the guide fins 42 (switching guides 40) via the operation member 54. The interference protrusion 53 roughly has an isosceles triangular shape when viewed from the front in the −Y direction, and has a pair of top and bottom inclined surfaces 531 (FIG. 5), which incline upward or downward according to the rotating direction of the timing belt 52. Because of this, the operation member 54 can easily be operated by the interference protrusion 53, receiving the interference protrusion 53 which descends as the timing belt 52 rotates, and the impact when the interference protrusion 53 disengages from the operation target plate 542 of the operation member 54 can be decreased.

The operation member 54 changes the position of the guide fins 42 from the retracting position S1 to a distributing position S2 via the guide shaft 41 when the interference protrusion 53 interferes. The operation member 54 has a triangular plate 541 having a right-angled triangular shape, which is directed so that the right angle portion comes to the upper right, and an operation target plate 542 which extends from the base portion of the triangular plate 541 toward the front with a predetermined width. The guide shaft 41 is secured by penetrating the connecting tube 543, which is disposed around the upper left corner of the triangular plate 541.

On one end of the guide shaft 41, a coil spring 43 having an extended portion on both ends is externally inserted between the triangular plate 541 and the side plate 311. A same coil spring 43 is also externally inserted on the other end of the guide shaft 41. The extended portion on one end of the coil spring 43 is hooked onto the side plate 311, and the extended portion on the other end is engaged to the back face of the operation target plate 542. Both ends of the switching guide 40 are suspended on the side plate 311 by one end of the coil spring 43. The operation member 54 is biased about the guide shaft 41 in the clockwise direction by this coil spring 43. By this bias, a part of the switching guide 40 contacts the fixed guide installed in the paper discharge path 310.

When the timing belt 52 rotates clockwise in FIG. 5, and the interference protrusion 53 moves downward from the pulley 51 in the highest level, the interference protrusion 53 interferes sequentially with an operation target plate 542 of each operation member 54 from the operation member 54 in the highest level. After rotating the operation target plate 542 about the guide shaft 41 counterclockwise in each operation member 54, the interference protrusion 53 disengages from the bottom end of the operation member 54, and moves to the next operation member 54. Therefore the operation member 54 oscillates about the guide shaft 41 every time the interference protrusion 53 passes. Along with this, the guide fin 42 also oscillates integrally about the guide shaft 41 between the retracting position S1 and the distributing position S2.

If rotation of the timing belt 52 stops in a state where the interference protrusion 53 interferes with an operation target plate 542 of any of the operation members 54, the guide fin 42 corresponding to the operation member 54 with which the interference protrusion 53 interferes is set to the distributing position S2. In the case of the example in FIG. 5, the guide fin 42 in the fourth level from the bottom is set to the distributing position S2. Therefore the paper P2, which is fed into the paper discharge path 310 in this state, is guided to the concave arc edge portion 422 at the bottom face of the guide fin 42, which is set to the distributing position S2, as shown by the two-dot chain line, and slides on the guide plate 314 in the frame, and is discharged to the paper discharge tray 32 in the fourth level.

The operation member 54 in the lowest level (second engaging unit) is for operating the guide plate 42', and is disposed in a state extending to the left from the guide shaft 41, so as to follow up the timing belt 52, which is turning to the left along the synchronous pulley 51*a* in the lowest level.

In the present embodiment, the home position of the interference protrusion 53 is directly under the synchronous pulley 51*a* in the lowest level. In the operation member 54 in the lowest level, a guide plate 42' is disposed instead of the switching guide 40. When the interference protrusion 53 is located in the home position, the guide plate 42' is set to the upward position T1, so the paper P2, which is fed, is always discharged to the general purpose tray 301 (see FIG. 9A). If the interference protrusion 53 is not in the home position, the guide plate 42' is set to the downward position T2. Thereby the paper P2, which is fed into the multi-tray unit 30, is scooped up by this guide plate 42', and is guided to the paper discharge path 310 in the multi-tray unit 30.

Figure 7:
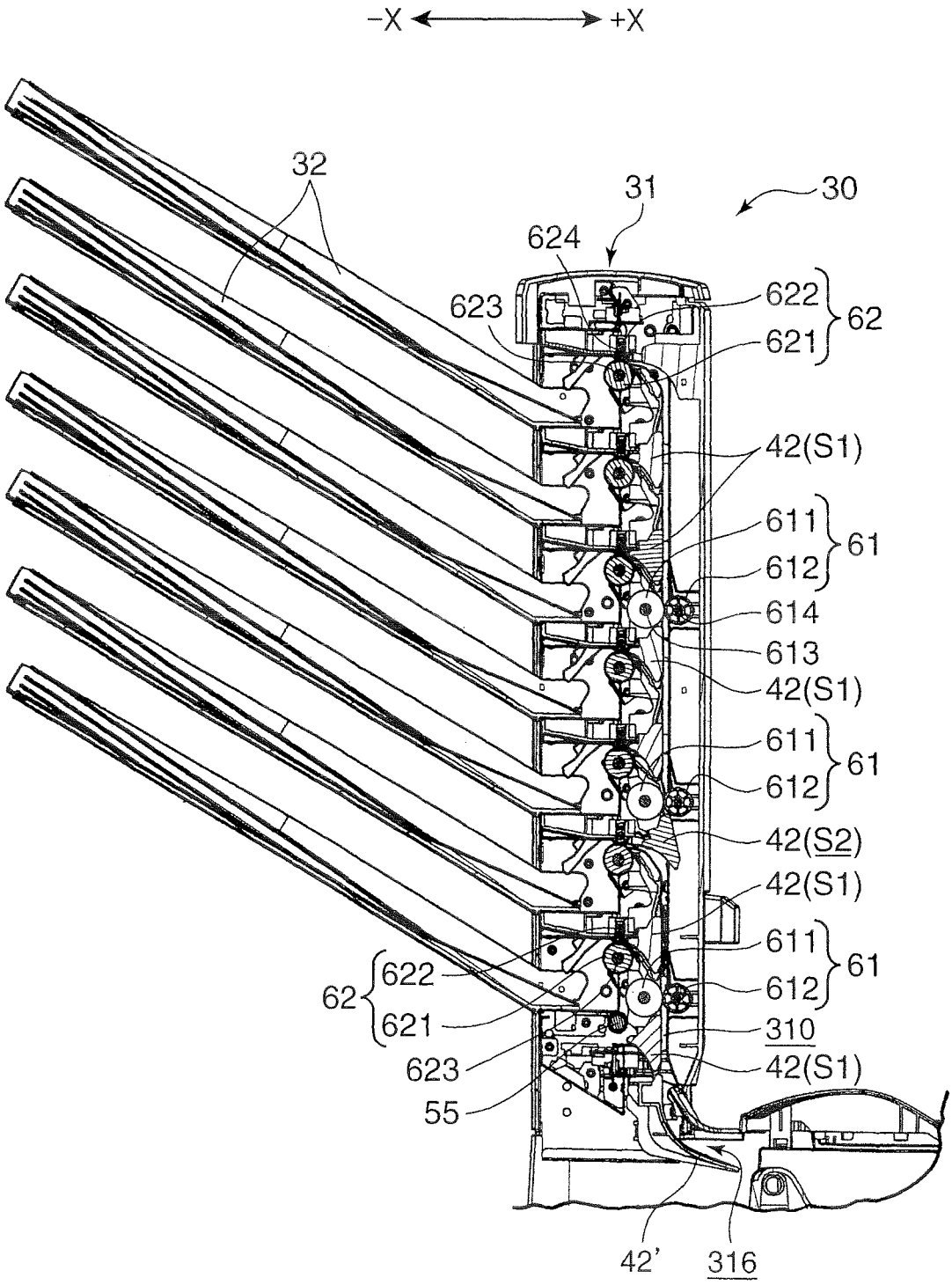
FIG. 7 is a cross-sectional view sectioned at the VII-VII line in FIG. 3.

Now the conveying mechanism 60 will be described referring to FIG. 7, with reference to other drawings when necessary. FIG. 7 is a cross-sectional view of FIG. 3 sectioned in VII-VII. The direction indicated with X in FIG. 7 is the same as FIG. 2 (−X: left, +X: right).

The conveying mechanism 60 has a vertical conveying mechanism 61, which conveys the paper P2 upward along the paper discharge path 310 with being guided by the guide fins 42 which are set to the retracting position S1, and a discharge conveying mechanism 62, which discharges the paper P2 to the paper discharge tray 32 with being guided by the guide fins 42 which are set to the distributing position S2.

The vertical conveying mechanism 61 has a first conveying roller 611, which is disposed at the left of the paper discharge path 310, so as to face the base of the paper discharge trays 32 in the first, third and fifth levels respectively, and a second conveying roller 612, which is disposed so as to face each first conveying roller 611 at the right side respectively. The second conveying roller 612 is a conveying roller disposed on the rear surface side of the right plate 315 (left surface side) of the frame 31. The paper P2, fed into the paper discharge path 310, is nipped by the first and second conveying rollers 611 and 612, and ascends along the paper discharge path 310 by the mutually opposite rotations of these rollers.

The first conveying roller 611 is rotatably supported about the first roller shaft 613, which is installed between the pair of side plates 311 of the frame 31, and the second conveying roller 612 is rotatably supported about the second roller shaft 614. The first and second rollers 611 and 612 rotate about the first and second roller shafts 613 and 614 by the driving of the drive force transfer mechanism 70.

The discharge conveying mechanism 62 has a third conveying roller 621 disposed facing the base portion (right edge portion) of each paper discharge tray 32 respectively, and a fourth conveying roller 622 disposed directly above each third conveying roller 621, facing the third conveying roller 621 respectively.

The third conveying roller 621 is rotatably supported about the third roller shaft 623, which is installed between a pair of side plates 311 of the frame 31. The fourth conveying roller 622 is rotatably supported about the fourth roller shaft 624. The third and fourth conveying rollers 621 and 622 rotate about the third and fourth roller shafts 623 and 624 by the driving of the drive force transfer mechanism 70.

The paper P2 is fed into the paper discharge path 310 via a receive slot 316, guided by the guide fin 42 which is set to the distributing position S2, and moves through the paper discharge path 310 to the paper discharge tray 32. This paper P2 is nipped by the third and fourth conveying rollers 621 and 622, and is discharged to the paper discharge tray 32 by the mutually opposite rotations of the third conveying roller 621 and the fourth conveying roller 622.

Figure 8:
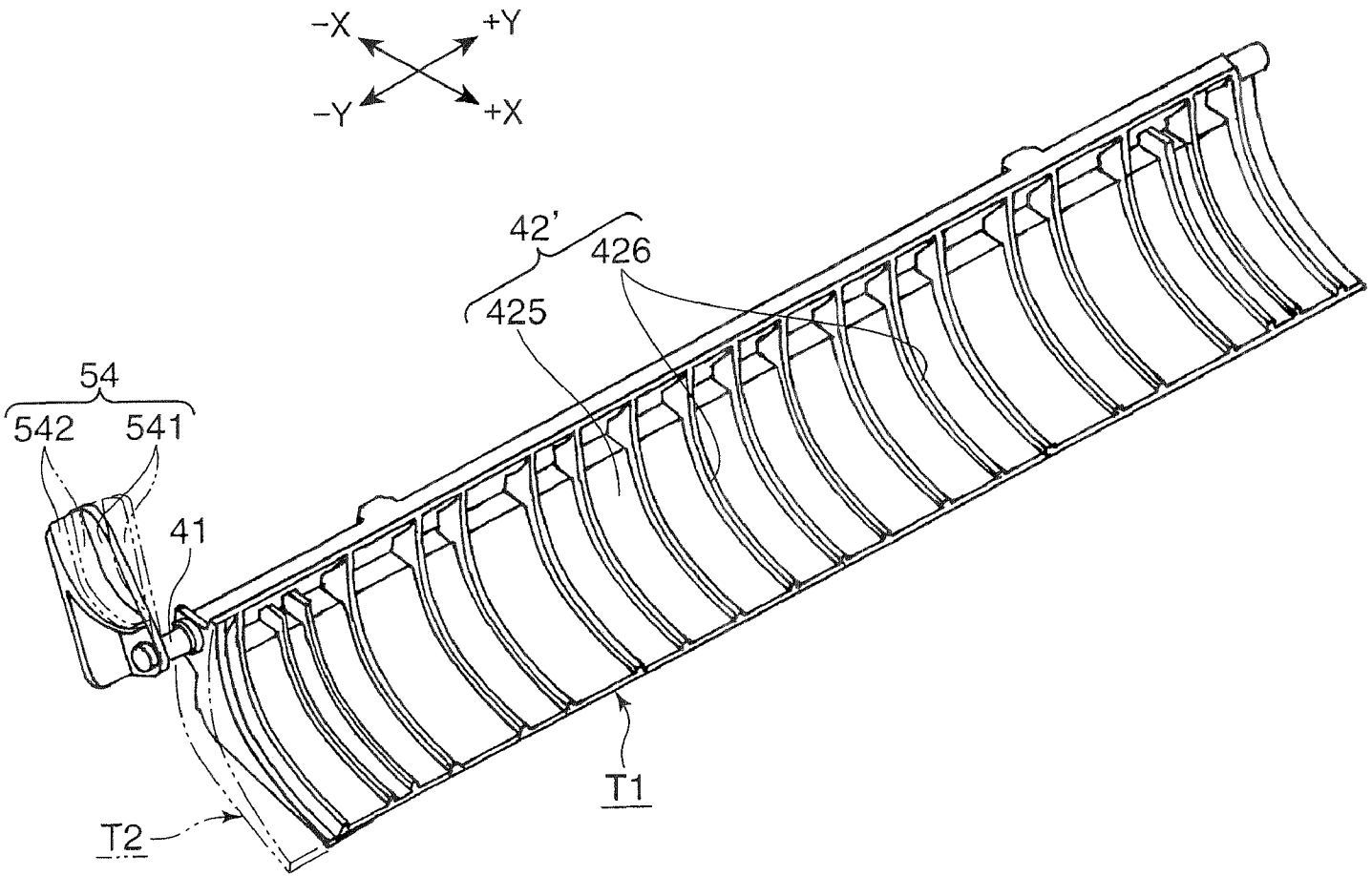
FIG. 8 is a perspective view depicting an embodiment of a guide plate.

FIG. 8 is a perspective view depicting an embodiment of the guide plate 42'. The direction indicated by X and Y in FIG. 8 is the same as FIG. 2 (−X: left, +X: right, −Y: forward, +Y: backward). The guide plate 42' has an arc shape plate main unit 425 which concaves upward, and protrudes from the guide shaft 41 inclined downward to the right throughout the entire length of the guide plate 42', and a plurality of lines of arc-shaped ribs 426 which are formed on the top face of the plate main body 425. The guide plate 42' can change position between an upward position T1 (see FIG. 9A), indicated by the solid line in FIG. 8, where the right edge is raised so as to scoop up the paper P2, and a downward position T2 (see FIG. 10A) indicated by the two-dot chain line in FIG. 8, where the right edge is lowered to guide the paper P2 to the paper discharge path 310.

Figure 9A:
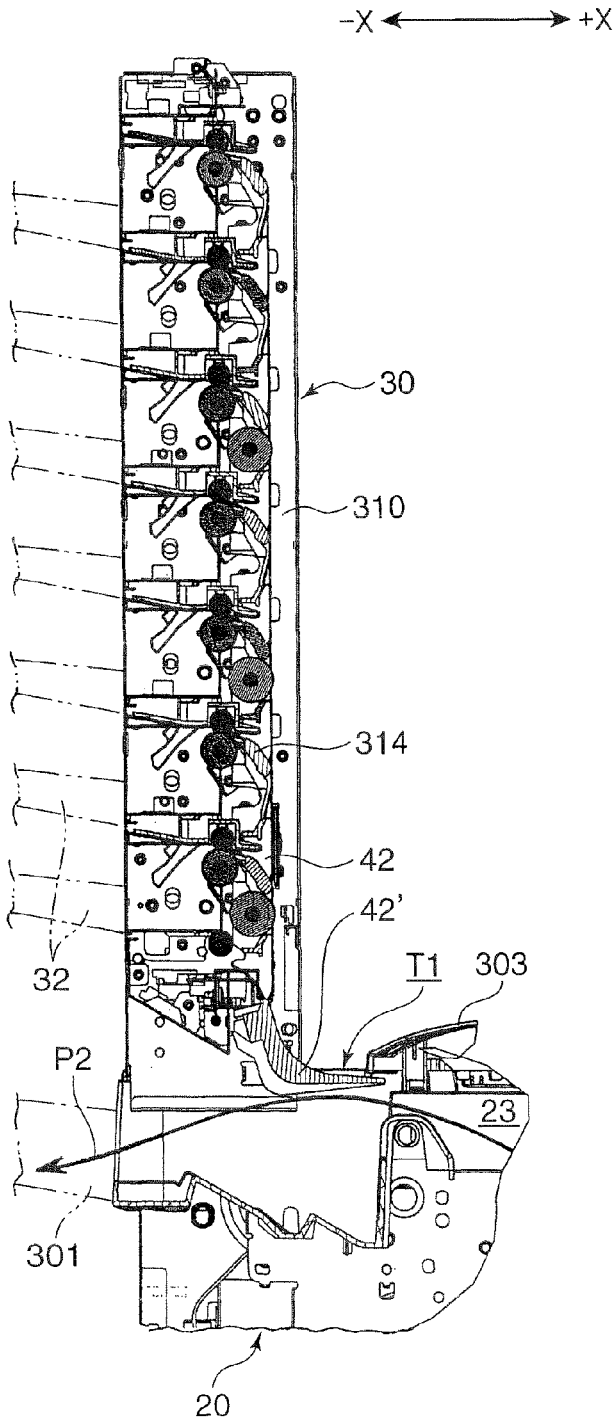
FIG. 9A and FIG. 9B are front cross-sectional views for explaining the functions of the multi-tray unit, and show a state when the guide plate is set in a position facing up.
Figure 9B:
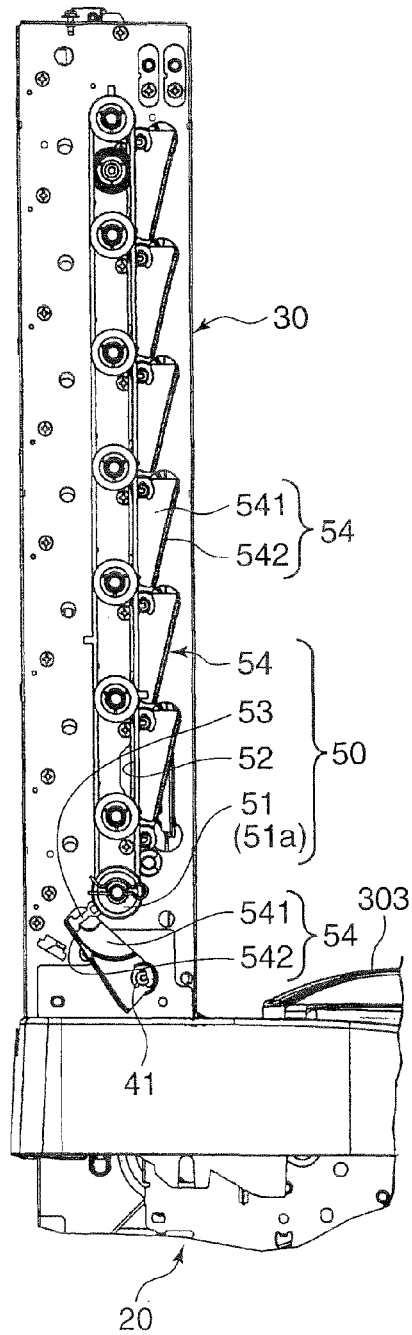
Figure 10A:
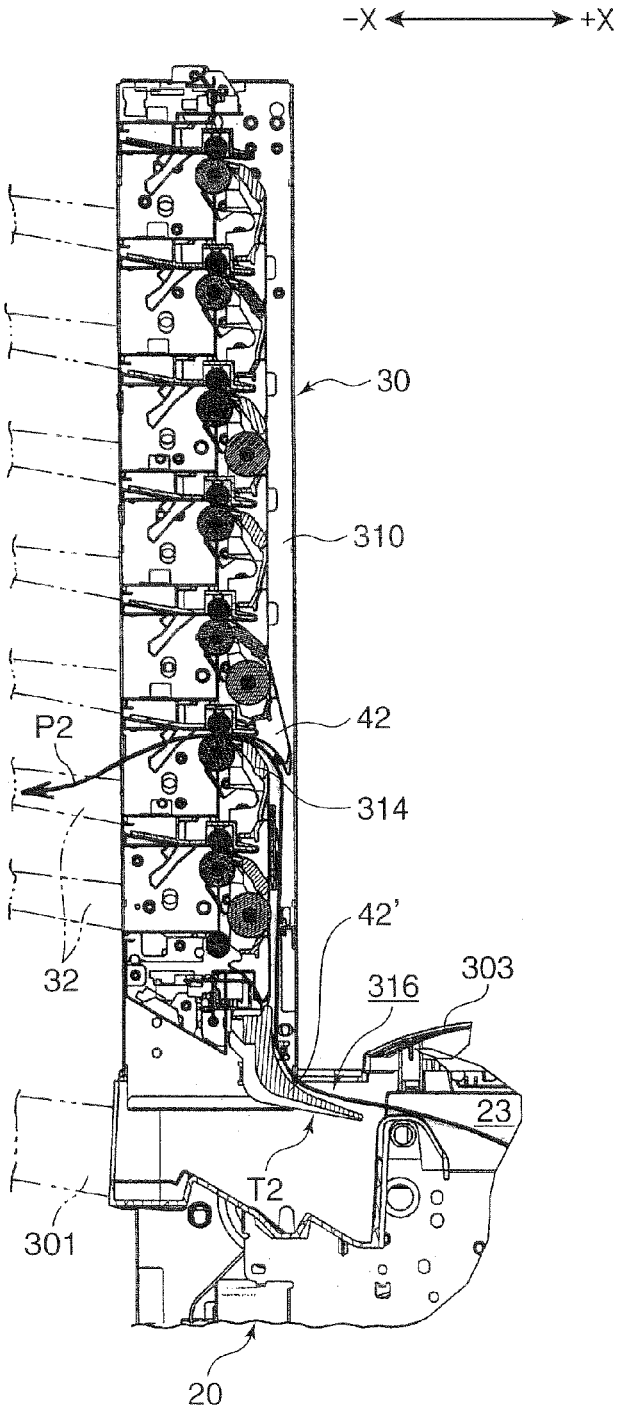
FIG. 10A and FIG. 10B show a state when the guide plate is set in a position facing down.
Figure 10B:
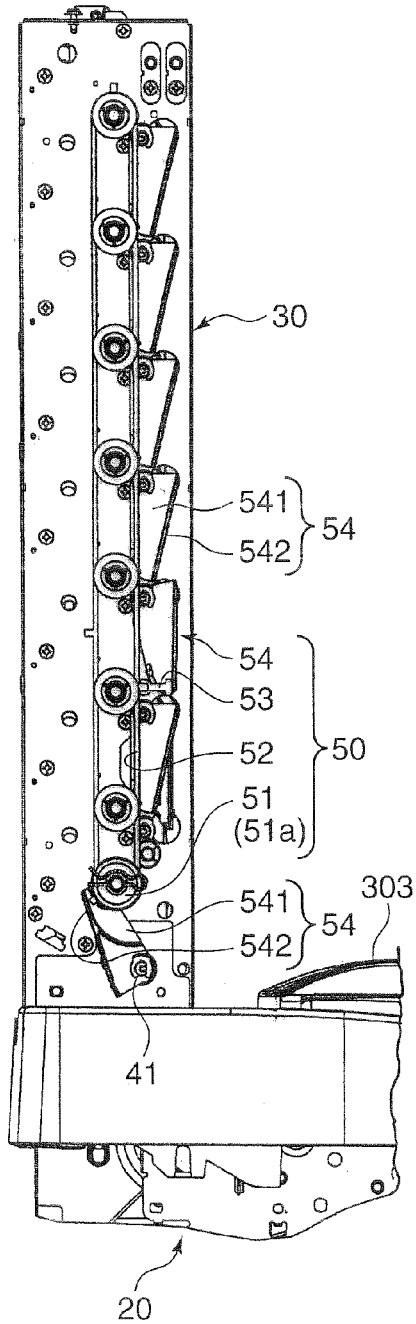

The discharge operation of the paper P2 before and after the multi-tray unit 30 will now be described based on FIG. 9A to FIG. 10B. FIG. 9A and FIG. 9B show a state where the guide plate 42' is set to the upward position T1, and FIG. 10A and FIG. 10B show a state where guide plate 42' is set to the downward position T2. FIG. 9A and FIG. 10A show the internal structure of the multi-tray unit 30 for describing the functions of the guide fin 42 and guide plate 42', and FIG. 9B and FIG. 10B show the structure of the multi-tray unit 30 from the front face side, for describing the functions of the interference protrusion 53 on the operation member 54.

The paper P2, which is fed from the sorting unit 23 to the guide plate 42' in a state where the guide plate 42' is set to the upward position T1, passes under the guide plate 42' and is discharged to the general purpose tray 301 as shown in FIG. 9A. The paper P2, which is fed from the sorting unit 23 in a state where the guide plate 42' is set to the downward position T2, on the other hand, is scooped up by the top face of the guide plate 42', as shown in FIG. 10A, and is guided to the paper discharge path 310. The paper P2 ascending along this paper discharge path 310 is guided to the bottom face of the guide fin 42 which is set to the distributing position S2, and is discharged to the paper discharge tray 32 corresponding to the guide fin 42 (the paper discharge tray 32 in the second level from the bottom in the example in FIG. 10A).

In more concrete terms, when the interference protrusion 53 is in the lowest level, which is the home position, and is therefore interfering with the operation target plate 542 of the operation member 54 in the lowest level, as shown in FIG. 9B, the guide plate 42' is set to the upward position T1 where the right edge thereof is raised (FIG. 9A). Hence the paper P2 fed from the sorting unit 23 passes under the guide plate 42' and is guided and discharged to the general purpose tray 301.

Whereas when the interference protrusion 53 is distant from the operation member 54 in the lowest level and is in a position interfering with the operation member 54 (position corresponding to the paper discharge tray 32 in the second level from the bottom in the case of the example shown in FIG. 10B), as shown in FIG. 10B, the guide plate 42' is biased in the counterclockwise direction by its own weight (or by the biasing force of the biasing member, which is not illustrated, in the case of another embodiment), and is set to the downward position T2. Hence the paper P2 fed from the sorting unit 23 is guided to the top face of the guide plate 42' and to the paper discharge path 310, and ascends along the paper discharge path 310. Then the paper P2 is discharged to the corresponding paper discharge tray 32 via the guide fin 42 which is set to the distributing position S2.

In the present embodiment, a change of the position of the guide plate 42' between the upward position T1 and downward position T2, for switching the destination of the paper P2 fed into the multi-tray unit 30 either to the general purpose tray 301 or the paper discharge tray 32, is performed by the rotation of the timing belt 52 having one interference protrusion 53. Sorting to a plurality of paper discharge trays 32 in the multi-tray unit 30 is also performed by the transporting operation of the one interference protrusion 53. This makes it unnecessary to install a dedicated mechanism to change the position of the guide plate 42' and each guide fin 42, and contributes to decreasing the number of components, and therefore decreases the manufacturing cost.

Figure 11:
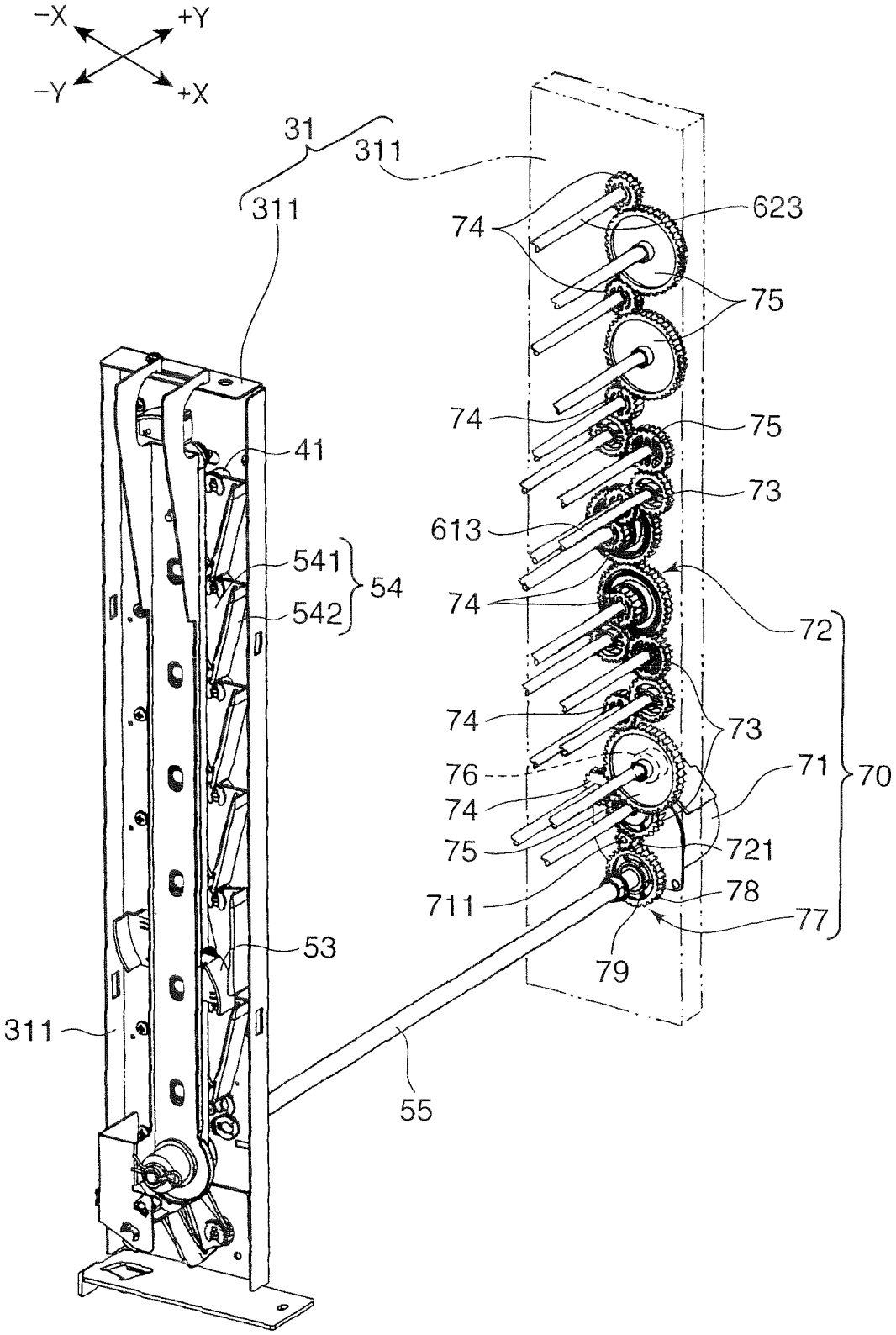
FIG. 11 is a perspective view depicting an embodiment of a drive force transfer mechanism.

Now the drive force transfer mechanism 70 will be described based on FIG. 11, with reference to other drawings when necessary. FIG. 11 is a perspective view depicting an embodiment of the drive force transfer mechanism 70. The direction indicated by X and Y in FIG. 11 is the same as FIG. 2 (−X: left, +X: right, −Y: forward, +Y: backward).

The drive force transfer mechanism 70 has a drive motor 71 (drive member) which is secured to the outer surface side of the side plate 311 in the back, a paper transport gear mechanism 72 to which the drive force of rotation of the drive motor 71 in one direction is transferred, and a guide fin gear mechanism 77 to which the drive force of rotation of the drive motor 71 in the other direction is transferred. For the drive motor 71, a stepping motor which rotates at a predetermined angle according to the input pulse signal is used. By using the stepping motor, the drive amount (in concrete terms, the rotation amount of the timing belt 52, that is, the position setting of the interference protrusion 53) can be controlled very accurately.

The paper transport gear mechanism 72 has a drive gear 721 which externally inserts concentrically to a drive shaft 711 so as to rotate integrally, three vertical transport gears 73 externally insert concentrically to three first roller shafts 613 respectively so as to rotate integrally, seven discharge transport gears 74 externally insert concentrically to seven third roller shafts 623 respectively so as to rotate integrally, and a predetermined number of idle gears 75 which are installed between the drive gear 721, vertical transport gears 73 and discharge transport gears 74 to assist the transfer of the drive force.

When the drive motor 71 drives clockwise, each vertical transport gear 73 rotates integrally with the first roller shaft 613, and rotates counterclockwise. Each discharge transport gear 74 rotates integrally with the third roller shaft 623, and rotates counterclockwise. The diameter dimension and number of gears to be installed are set for each idle gear 75 so that such rotation is possible.

A second one-way clutch 76 (FIG. 6) is disposed at an appropriate position in the lowest area of the paper transport gear mechanism 72. When the drive shaft 711 rotates clockwise (reversely rotates) about the axis center, the drive force is transferred to the vertical transport gear 73 via the second one-way clutch 76, and the vertical transport gear 73 rotates counterclockwise. When the drive shaft 711 rotates counterclockwise (positively rotates) about the axis center, on the other hand, the rotation is not transferred to the vertical transfer gear 73.

The guide fin gear mechanism 77 has a guide fin driven gear 78, and a first one-way clutch 79 which is disposed in an appropriate position of the installation shaft 55. The guide fine driven gear 78 externally inserts concentrically to the installation shaft 55, which is installed penetrating the side plates 311 at the front and back of the frame 31, so as to rotate integrally, and engages with the drive gear 721 in a position directly under the drive shaft 711.

The first one-way clutch 79 is installed between the outer circumferential surface of the installation shaft 55 and inner circumferential surface of the guide fin driven gear 78. By this, only when the drive shaft 711 rotates counterclockwise, the rotation of the guide fin driven gear 78 can be transferred to the installation shaft 55, and when the drive motor 71 drives for rotation clockwise, the rotation of the guide fin driven gear 78 is not transferred to the installation shaft 55.

Therefore when the drive motor 71 drives clockwise, the drive force is transferred only to the paper transport gear mechanism 72, and the drive force is not transferred to the guide fin gear mechanism 77 (that is, it does not move). When the drive motor 71 drives counterclockwise, on the other hand, the drive force is transferred only to the guide fin gear mechanism 77, and the drive force is not transferred to the paper transport gear mechanism 72.

This is because of the characteristic of the paper transport gear mechanism 72 and the guide fin gear mechanism 77, which do not move integrally, one always stops while the other is operating. In the present embodiment, the paper transport gear mechanism 72 and the guide fin gear mechanism 77 are driven respectively by changing the drive direction of the one drive motor 71. According to this configuration, the number of components can be decreased compared with the case of using dedicated drive motors respectively.

The function of the multi-tray unit 30 will now be described using the same drawings (FIG. 9A to FIG. 10B) used for describing the guide plate 42', with reference to other drawings when necessary.

First when the interference protrusion 53 of the timing belt 52 is set at the lowest home position, as shown in FIG. 9B, the interference protrusion 53 rotates the operation target plate 542 of the operation member 54 in the lowest level counterclockwise about the guide shaft 41 by a predetermined amount against the biasing force of the coil spring 43 (FIG. 5). Because of this, the guide shaft 41, integrated with the operation target plate 542, rotates about the axis by the same amount, thereby the guide plate 42' rotates the same amount to be set to the upward position T1. Therefore the paper P2 fed from the sorting unit 23 passes under the guide plate 42', and is discharged to the general purpose tray 301, as shown in FIG. 9A.

For the paper P2 to be processed for discharge in the multi-tray unit 30, the guide plate 42' must be set to the downward position T2, as shown in FIG. 10A. Specifically, if the timing belt 52 rotates clockwise, the interference protrusion 53 in the home position is disengaged from the operation member 54 in the lowest position, and ascends. At this point, the guide plate 42' is set to the downward position T2.

The ascended interference protrusion 53 moves around the pulley 51 in the highest level, and descends. Then the interference protrusion 53 interferes with the operation target plate 542 of the highest operation member 54, rotates the operation target plate 542 about the guide shaft 41 counterclockwise, then passes through the operation target plate 542, and moves to the next operation member 54.

For example, as shown in FIG. 10B, it is assumed that the rotation of the timing belt 52 is stopped by the interference protrusion 53 at the position of the operation member 54 in the second level from the bottom. In this case, the interference protrusion 53 rotates the operation target plate 542 in the second level from the bottom about the guide shaft 41 counterclockwise for a predetermined amount against the biasing force of the torsion bar spring 43. Hence the corresponding guide fin 42 changes position from the retracting position S1 to the distributing position S2.

Therefore the paper P2, fed from the sorting unit 23 in this state, is guided by the guide fin 42, and is fed into the paper discharge path 310 via the receive slot 316, and ascends along the paper discharge path 310. In the case of the example in FIG. 10A, when the paper P2 reaches the guide fin 42 in the second level from the bottom, the guide fin 42 is set to the distributing position S2, so the paper P2 is caught by the guide fin 42, guided by the concave arc edge portion 422 on the bottom face of the guide fin 42, and is discharged to the paper discharge tray 32 in the second level from the bottom.

In this way, the paper P2, which is fed into the multi-tray unit 30, is discharged to the paper discharge tray 32 corresponding to the operation member 54 in which the interference protrusion 53 is stopped. Hence by controlling the rotation amount of the timing belt 52 based on the home position of the interference protrusion 53, the paper P2 can be appropriately discharged to the pre-selected paper discharge tray 32.

Figure 12:
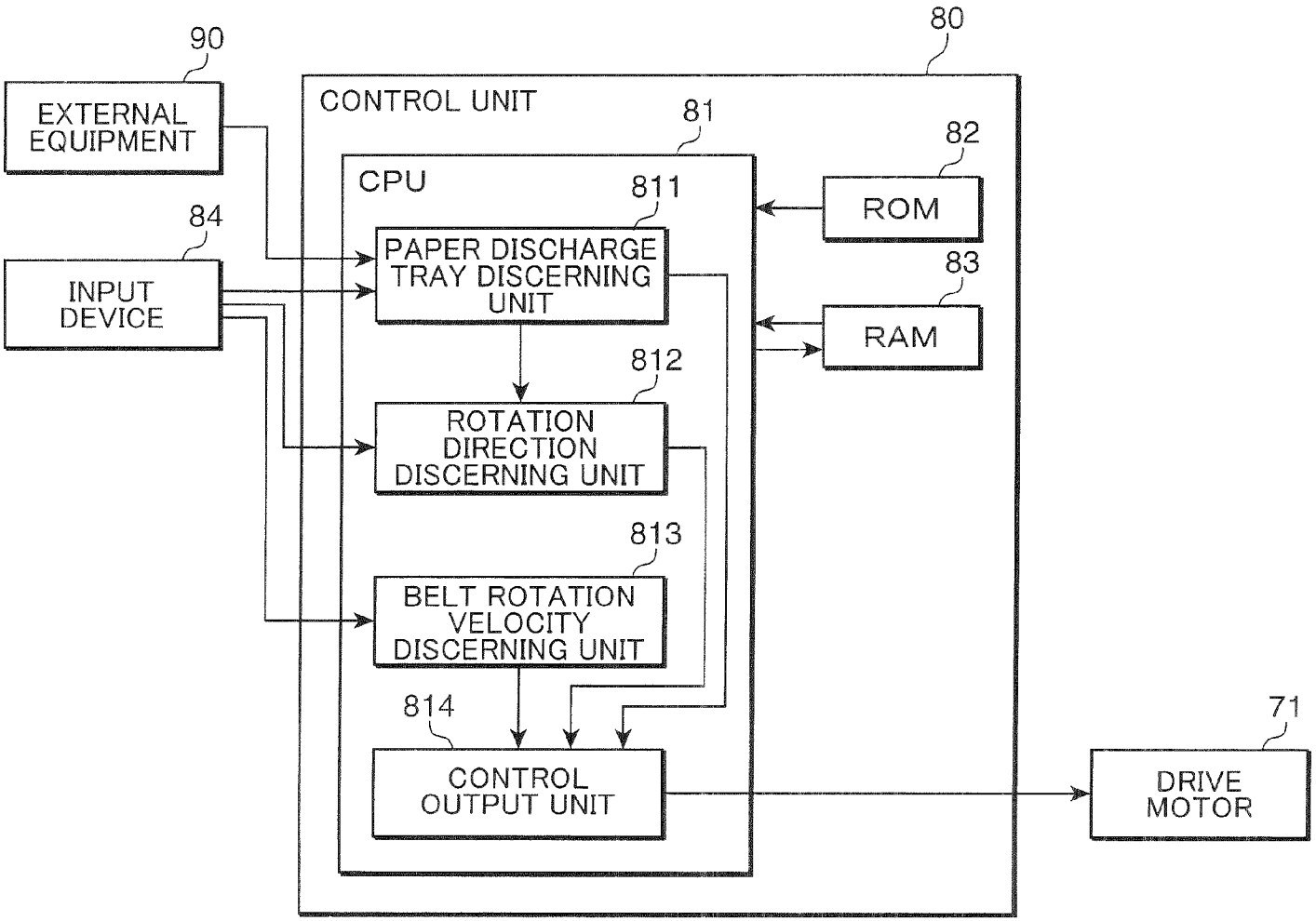
FIG. 12 is a block diagram depicting a functional configuration of a control unit.

Now the discharge control of the paper P2 to the multi-tray unit 30 by the control unit 80 will be described based on FIG. 12. FIG. 12 is a block diagram depicting an embodiment of the discharge control of the paper P2 to the multi-tray unit 30 by the control unit 80.

The control unit 80 controls the paper discharge operation to the multi-tray unit 30, and has a CPU (Central Processing Unit) 81 which is a processor, a ROM (Read Only Memory) 82 which is attached to the CPU 81, and a RAM (Random Access Memory) 83.

The ROM 82 stores programs to execute control, and the position change control of the guide fins 42 of the switching guide 40 is executed based on this program. The RAM 83, on the other hand, is used as an area where various data, which is used temporarily, is temporarily written or read.

The CPU 81 has a paper discharge tray discerning unit 811 (selection unit) which discerns which paper discharge tray 32 is selected, a rotation direction discerning unit 812 which discerns the rotation direction of the drive motor 71 according to the purpose of driving, a belt rotation velocity discerning unit 813 (velocity control unit) which discerns the rotation velocity of the timing belt 52 to be set, and a control signal output unit 814 (drive control unit) which outputs a predetermined control signal to the drive motor 71 based on the discernment result of the paper discharge tray discerning unit 811 and belt rotation velocity discerning unit 813.

An overview of the flow of the operation of related equipment by control of the CPU 81 and the flow of the paper fed P2 into the multi-tray unit 30 is as follows. If one paper discharge tray 32 is selected, the CPU 81 drives the drive motor 71 in the opposite direction from the direction when the paper P2 is being discharged, and rotates the timing belt 52 so that the interference protrusion 53 is positioned to the operation member 54 corresponding to the selected paper discharge tray 32 and is stopped. Thereby the guide fin 42 corresponding to the selected paper discharge tray 32 is set to the distributing position S2.

Then paper P2 discharge processing is started at the post-processing apparatus 20 side, and at the same time, the drive motor 71 is driven in a direction to convey the paper P2. By this, the paper P2, guided from the post-processing apparatus 20 to the paper discharge travel path 310 of the multi-tray unit 30 via the guide plate 42', is guided by the guide fin 42 corresponding to the selected paper discharge tray 32, and is discharged to the selected paper discharge tray 32.

If the lowermost paper discharge tray 32, in particular, is selected, the timing belt 52 must be rotated for about one cycle clockwise for the interference protrusion 53 in the home position to reach the operation member 54 of the paper discharge tray 32. Therefore if the image forming apparatus 1 is a high-speed model of which convey speed of the paper P2 (paper discharge speed) is fast, the position of the guide fins 42 is changed from the retracting position S1 to the distributing position S2 in advance immediately after selection of the paper discharge tray 32 and before starting discharge of the paper to the multi-tray 30. If the image forming apparatus 1 is a low-speed model of which paper discharge speed is slow, on the other hand, position of the guide fins 42 may be changed after paper discharge to the multi-tray unit 30 is started.

The home position of the interference protrusion 53 is set to a position where the paper P2 is discharged to the general purpose tray 301, which is most frequently used. This contributes to minimizing the time required for switching operation of the guide plate 42'.

Now the functions of the paper discharge tray discerning unit 811, rotation direction discerning unit 812, belt rotation velocity discerning unit 813 and control signal output unit 814, which are functional components of the CPU 81, will be described individually.

In the paper discharge tray discerning unit 811, information transferred from an external equipment 90, such as a printer and facsimile, via an interface, and information on the selection of the paper discharge tray 32 from the input device 84, which is installed in an appropriate location of the composite machine 10, are input.

For example, the paper discharge tray discerning unit 811 acquires information on the paper discharge tray 32 at the paper discharge destination which is set by the printer driver running on the personal computer, and outputs the specified number (e.g. level number from the bottom) of this paper discharge tray 32 to the control signal output unit 814 as a command signal so as to discharge the paper P2 to this paper discharge tray 32. The control signal output unit 814, to which this command signal is input, outputs the control signal to the drive motor 71, so as to change the position of the guide fin 42 corresponding to the selected paper discharge tray 32 from the retracting position S1 to the distributing position S2.

In concrete terms, this control signal is a pulse signal including a pulse count required for transporting the interference protrusion 53 located in the home position to the operation member 54 corresponding to the selected paper discharge tray 32. The drive shaft 711 of the drive motor 71, to which this pulse signal is input, rotates for the amount corresponding to the pulse count to rotate the timing belt 52. Thereby the interference protrusion 53 reaches and interferes with the target operation member 54, and rotates the operation target plate 542 about the guide shaft 41, and the selected guide fin 42 changes the position from the retracting position S1 to the distributing position S2.

Then the paper P2 is fed into the paper discharge path 310 in the multi-tray unit 30 from the sorting unit 23 via the receive slit 316, and is discharged to the selected paper discharge tray 32 via the guide fin 42 which is set to the distributing position S2. This discharge operation of the paper P2 is executed until this job completes. When the job completes, the timing belt 52 is rotated by the driving of the drive motor 71 based on the control signal from the control signal output unit 814, whereby the interference protrusion 53 returns to the original home position, and stands by for the next job.

The input device 84 accepts a predetermined input operation by the user when the composite machine 10 is used as a copier and when the discharge destination of the paper P2, copied by the copy processing, is set. If the composite machine 10 is used as a facsimile device, the discharge destination, used only by the facsimile, can be set in advance.

According to the present embodiment, in the case of using the composite machine 10 as a copier, the guide plate 42' remains set to the upward position T1 (see FIG. 9A) if the key operation to select the discharge destination is not specifically performed in the input device 84. Therefore, if the discharge destination is not specifically selected, the paper P2 after copying is completely discharged to the general purpose tray 301. If processing to select a paper discharge tray 32 is performed by the key operation in the input device 84, on the other hand, this signal is input to the paper discharge timing discerning unit 811. Thereby control, the same as when an ID number from the above mentioned external equipment 90 is input to the paper discharge tray discerning unit 811, is performed, and the paper P2 is discharged to the selected paper discharge tray 32.

The rotation direction discerning unit 812 discerns whether the drive motor 71 is driven for rotating the timing belt 52 (first mode), or the drive motor 71 is driven for conveying the paper P2 to the target paper discharge tray 32 (second mode), in order to discharge the paper P2 by switching the guide fin 42 corresponding to the selected paper discharge tray 32. The direction of driving for rotation of the drive motor 71 is set according to this discernment result.

If it is discerned that the first mode is set, the rotation direction discerning unit 812 outputs the signal to rotate the drive motor 71 in the positive direction via the control signal output unit 814. Thereby the timing belt 52 is driven in one direction (clockwise in the case of the example in FIG. 5) for the rotation amount discerned by the paper discharge tray discerning unit 811. When the position of the guide fin 42, corresponding to the selected paper discharge tray 32, is changed from the retracting position S1 to the distributing position S2 by a predetermined rotation of the timing belt 52, the drive motor 71 is stopped. The stop timing of the drive motor 71 is discerned by the paper discharge tray discerning unit 811. The drive motor 71 is stopped once by the stop signal from the paper discharge tray discerning unit 811 via the control signal output unit 814.

The second mode is executed after the first mode. In the second mode, the rotation direction discerning unit 812 has the control signal output unit 814 to output the control signal to drive the drive motor 71 for rotation in the reverse direction. By this control, the drive motor 71 rotates in reverse, and the vertical conveying mechanism 61 (FIG. 7) and the discharge conveying mechanism 62 are driven by the operation of the paper transport gear mechanism 72 via the first one-way clutch 76 (FIG. 6). The paper P2, after being conveyed along the paper discharge path 310, is discharged to the selected paper discharge tray 32 via the guide fins 42, which are set to the distributing position S2.

When discharge of the paper P2 to the paper discharge tray 32 completes, driving of the drive motor 71 is stopped. The completion of the paper discharge is judged based on the output of the PI (Photo Interruptor) sensor, which is not illustrated, disposed on the paper discharge path toward the paper discharge tray 32.

The input device 84 has a dial, which is not illustrated, for changing the rotation velocity of the timing belt 52. This dial is used for suppressing the generation of noise, which is generated when the interference protrusion 53 interferes with the operation target plate 542, or when the interference is cleared, due to the excessively fast rotation velocity of the timing belt 52, for example.

A table to indicate the relationship between the turning amount of the dial in one direction and the rotation velocity of the timing belt 52 (concretely, the drive velocity of the drive motor 71) is stored on the ROM 82. The belt rotation velocity discerning unit 813 refers to the table and sets the drive velocity of the drive motor 71 based on the turning amount input of the dial, and outputs a command signal, to drive the drive motor 71 with this drive velocity, to the control signal output unit 814.

The control signal output unit 814, which received this command signal, changes the drive velocity of the drive motor 71 (concretely, decreases the drive velocity) by adjusting the cycle of the drive pulses to be applied to the drive motor 71, so as to adjust the rotation velocity of the timing belt 52. For example, the generation of noise due to the interference protrusion 53 of the timing belt 52 interfering with the operation target plate 542 of the operation member 54 can be suppressed if the rotation velocity is decreased.

If the priority is to improve the discharge efficiency of the paper P2, allowing the generation of noise, then the dial is operated backward from the reference position. Thereby the drive velocity of the drive motor 71 is increased, and the rotation velocity of the timing belt 52 increases accordingly, so the position of the guide fins 42 of the selected paper discharge tray 32 can be quickly changed from the retracting position S1 to the distributing position S2.

As described above, the image forming apparatus 1 according to the present embodiment includes the composite machine 10 and the post-processing apparatus 20, which is connected at the downstream end of the composite machine 10. In the post-processing apparatus 20, a multi-tray unit 30, which has a rectangular parallelopiped frame 31 for discharging the paper P2 after image formation processing, is disposed.

The multi-tray unit 30 has a paper discharge path 310 for conveying paper P2 to be discharged, a plurality of paper discharge trays 32 which are disposed in parallel along the paper discharge path 310, a plurality of switching guides 40 having guide fins 42 of which position can be changed between the retracting position S1 and the distributing position S2, and a position change mechanism 50 which changes the position of the guide fins 42. The position change mechanism 50 sets the guide fins 42 corresponding to a paper discharge tray 32, which is not selected as a paper discharge destination, to the retracting position S1, and changes a guide fins 42 corresponding to one selected paper discharge tray 32 from the retracting position S1 to the distributing position S2 by the driving of one drive motor 71.

According to the multi-tray unit 30 with such a configuration, the position change mechanism 50 changes the position of the guide fins 42 of the pre-selected paper discharge tray 32 from the retracting position S1 to the distributing position S2 by the driving of one drive motor 71, so only one drive mechanism is required, unlike a prior art which uses a plurality of drive mechanisms, such as solenoid devices, corresponding to each guide fin 42. Therefore the number of components can be decreased, and as a result, the device cost can be decreased. Also compared with a conventional method in which paper P2 is conveyed forward first and then conveyed backward, the paper discharge time can be decreased, and paper discharge efficiency is improved.

The position change mechanism 50 has a timing belt 52 which changes the position of the guide fins 42 by rotating in one direction along the paper discharge path 310, and the timing belt 52 has the interference protrusion 53 for changing the position of the guide fin 42. Only a guide fin 42 at a position where the interference protrusion 53 is stopped is set to the distributing position S2. Therefore the paper P2, which is fed into the paper discharge path 310, is guided to the guide fins 42 which are set to the distributing position S2, and is discharged to the selected paper discharge tray 32.

The interference state of the interference protrusion 53 with the operation member 54 is cancelled when the interference protrusion 53 passes through the operation target plate 542 of the operation member 54 by the rotation of the timing belt 52. This makes the structure of the position change mechanism 50 extremely simple, and contributes to decreasing the device cost.

The present invention is not limited to the above embodiments, but also includes the following.

(1) In the above embodiments, the image forming apparatus 1, that includes the multi-tray unit 30 having a plurality of levels of paper discharge trays 32, was described using a device having the composite machine 10 at the upstream side and the post-processing apparatus 20 at the downstream side connected to the composite machine 10 as an example. Instead, the multi-tray unit 30 may be directly installed in the composite machine 10 without directly installing the post-processing apparatus 20. And instead of the composite machine 10, one of a printer, copier and facsimile device may be used.

(2) In the example in FIG. 5, there is only one interference protrusion 53 which is disposed in the timing belt 52, but one interference protrusion 53 may be installed for each of the point-symmetric positions on the timing belt 52, that is, a total of two interference protrusions 53 may be disposed. Thereby one interference protrusion 53 can be located in the highest position, while the other interference protrusion 53 is in the home position, and as a result, the position of the interference protrusion 53, with respect to the operation member 54, can be more quickly changed. Furthermore, three or more interference protrusions 53 may be disposed on the timing belt 52 with an equal interval.

The above mentioned embodiments primarily include an invention having the following configurations.

According to an aspect of the configuration of the sheet discharge device of the present invention, sheet fed into the sheet discharge path passes through the switching guide if the switching guide is in the retracting position, or is guided by the switching guide and is discharged to the sheet discharge tray if the switching guide is in the distributing position. The switching mechanism changes the switching guide of a preselected sheet discharge tray from the retracting position to the distributing position by the movement of one transporting mechanism driven by the drive member. Therefore, only one drive mechanism is required, and compared with a prior art which uses a plurality of drive mechanisms, such as a solenoid devices, corresponding to each switching guide, the number of components is decreased, which contributes to decreasing the device cost. Since operation to switch back the sheet fed into the sheet discharge path is not performed, the sheet discharge efficiency is good.

It is preferable that the above configuration further includes: a first engaging member installed in the switching guide, whereby the first engaging unit engages with the switching piece so as to change the position of the switching guide from the retracting position to the distributing position. According to this configuration, the first engaging member, which engages with the switching piece, is installed, so the position of the switching guide can be stably changed.

In the above configuration, it is preferable that the sheet discharge path includes a vertical conveying path which extends in a vertical direction, and the plurality of sheet discharge trays are arranged in the vertical direction with a predetermined pitch along the vertical conveying path. According to this configuration, the space factor of the plurality of sheet discharge trays can be decreased.

In the above configuration, it is preferable to further include a general purpose tray, disposed below the lowermost sheet discharge tray out of the plurality of sheet discharge trays, and for discharging a sheet that is not discharged to any of the plurality of sheet discharge trays, and a guide plate being changed a position thereof for switching the sheet discharge destination between the general purpose tray and the sheet discharge tray by the switching mechanism.

According to this configuration, when none of the plurality of sheet discharge trays are selected, the position of the guide plate is set to the general purpose tray, so the sheet is discharged to the general purpose tray. In particular, if the position to set the guide plate to the position for the general purpose tray is set in advance as the home position of the switching piece, the sheet is automatically discharged to the general purpose tray when no sheet discharge tray is specifically selected. This makes it unnecessary to change the position of the guide plate to the general purpose tray each time, and is therefore convenient. Furthermore, the switching mechanism for the sheet discharge trays is also used for changing the position of the guide plate for the general purpose tray, so the number of components is decreased, which contributes to decreasing the manufacturing cost.

In this case, it is preferable to further have a second engaging member which is installed in the guide plate, wherein the second engaging member engages with the switching piece so as to change the position of the guide plate. According to this configuration, the second engaging member which engages with the switching piece is installed, so the position of the guide plate is stably changed.

In the above configuration, it is preferable that the transporting member is an endless belt which is installed along the sheet discharge path, and rotates in one direction by the drive member, the switching piece is a protrusion protruding from the endless belt so as to be capable of interfering with the switching guide, and a rotation of the endless belt stops in a state where one switching guide out of the plurality of switching guides, and the protrusion interfere with each other, whereby the position of the one switching guide is set to be the distributing position.

According to this configuration, the endless belt is rotated in one direction, and the rotation of the endless belt is stopped when the protrusion of the endless belt reaches the position of the switching guide corresponding to the selected sheet discharge tray, whereby the position of the switching guide can be changed from the retracting position to the distributing position. Hence the sheet can be discharged to the selected target sheet discharge tray, even if the structure is quite simple.

In this case, it is preferable to further includes a first engaging member engaging with the protrusion so as to change the position of the switching guide, a biasing member biasing the switching guide toward the retracting position, and a guide shaft which extends in a direction perpendicular to the sheet conveying direction, and integrally rotates with the switching guide about an axis center, whereby the first engaging member is secured at an edge of the guide shaft so as to rotate integrally, and interferes with the protrusion so as to change the position of the switching guide from the retracting position to the distributing position, and the interfering state of the protrusion and the first engaging member cancels out when the protrusion passes the first engaging member by rotation of the endless belt.

According to this configuration, the switching guide is normally biased toward the retracting position about the guide shaft by the biasing member, and the position is therefore set to the retracting position. When the protrusion is moved to the switching guide in this state, by the rotation of the endless belt, this protrusion interferes with the first engaging unit, and this interference state cancels out when the protrusion passes the first engaging unit by the endless belt in continuous rotation. By the protrusion stopping at a position of the first engagement unit corresponding to the selected sheet discharge tray, the position of the switching guide is changed to the distributing position via the first engaging unit, against the biasing force of the biasing member. In order to return the switching guide, which is set to the distributing position, to the original retracting position, the endless belt is rotated so that the first engaging unit is passed by the protrusion. Thereby the interference state of the protrusion with the first engaging unit cancels out, and the switching guide returns to the original retracting state by the biasing force of the biasing mechanism.

In the above configuration, it is preferable to further include a velocity control unit which controls the drive member to adjust the rotating velocity of the endless belt. According to this configuration, noise due to the rotation of the endless belt can be suppressed, and high-speed sheet discharge processing can be supported.

In the above configuration, it is preferable to further comprise a control unit which controls an operation of discharging sheet, and this control unit includes a selection unit for selecting a sheet discharge tray to which sheet is discharged, and a drive control unit for controlling the operation of the drive member, so that the switching guide corresponding to the selected sheet discharge tray and the switching piece interfere with each other. According to this configuration, sheet after print processing is automatically discharged to a sheet discharge tray which is pre-selected by the selection unit, using the drive control of the drive motor by the control unit.

In the above configuration, it may further include a control unit which controls an operation of discharging sheet, wherein the drive member is a drive motor rotating the endless belt, and the control unit includes a selection unit selecting a sheet discharge tray to which sheet is discharged, and a drive control unit which controls the rotating position of the endless belt with the drive motor, so that the first engaging unit corresponding to the selected sheet discharge tray and the protrusion interfere with each other.

In the above configuration, it is preferable to further include a pair of sheet discharge rollers which conveys sheet to the sheet discharge tray, wherein the pair of sheet discharge rollers is driven for rotation by a drive force generated by the drive member. According to this configuration, the drive source of the sheet discharge roller can be omitted.

In this case, it may be constructed such that the transporting member is an endless belt, installed along the sheet discharge path, and rotating in one direction by the drive member, and the drive member is a drive motor rotating the endless belt, the sheet discharge device further includes: a pulley around which the endless belt is wound thereon and which drives the endless belt for rotation by drive force supplied from the drive motor, a first one-way clutch installed on a rotation axis of the pulley; and a second one-way clutch installed on a rotation axis of the sheet discharge roller, wherein the endless belt is rotated by rotational driving of the pulley via the first one-way clutch when the drive motor rotates in a forward direction, and the sheet discharge roller is driven for rotation via the second one-way clutch when the drive motor rotates in a reverse direction.

In the above configuration, it is preferable that the drive member is a drive motor which rotates the endless belt, further comprising a first pulley around which the endless belt is wound and which drives the endless belt for rotation by the drive force supplied from the drive motor, and a second pulley which is disposed at the inner circumference side of the endless belt, and the second pulley is disposed at a position to suppress the deformation of the endless belt by pressing force due to the interference of the protrusion of the switching piece and the switching guide. According to this configuration, deformation of the endless belt can be suppressed, so the protrusion of the switching piece and the switching guide can interfere with certainty.

An image forming apparatus according to another aspect of the present invention has an image forming unit which performs image forming processing on sheet and a sheet discharge device having the above mentioned configuration.

According to the above described present invention, unlike a prior art in which a plurality of drive mechanisms are disposed corresponding to each switching guide, the position of the switching guide of the sheet discharge tray can be changed from the retracting position to the distributing position by the operation of one transporting member. Therefore, the sheet can be discharged to the selected sheet discharge tray with certainty, and sheet discharge efficiency can be improved.

This application is based on Japanese patent application serial No. 2008-175949, filed in Japan Patent Office on Jul. 4, 2008, the contents of which is hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet discharge device, comprising:

a sheet discharge path for discharging a sheet to be discharged;

a plurality of sheet discharge trays disposed along the sheet discharge path;

a plurality of switching guides disposed in the sheet discharge path corresponding to the sheet discharge trays, and being changed a position thereof between a retracting position for being retracted so that the sheet being conveyed can pass through, and a distributing position for distributing a sheet being conveyed to the sheet discharge tray; and a switching mechanism which changes the position of the switching guide between the retracting position and the distributing position, the switching mechanism including an endless belt which is installed along the sheet discharge path and which rotates in one direction, a protrusion which protrudes from the endless belt so as to be capable of interfering with the switching guide, and a drive member which rotates the endless belt, the protrusion, interfering with the switching guide to switch the position of the switching guide, the endless belt moving the projection among the plurality of switching guides, a rotation of the endless belt stopping in a state where one switching guide out of the plurality of switching guides and the protrusion interfere with each other, whereby the position of the one switching guide is set to be the distributing position, the switching mechanism further including a first pulley around which the endless belt is wound and which drives the endless belt for rotation by drive force supplied from the drive member; and a second pulley disposed at the inner circumference side of the endless belt, the second pulley being disposed at a position to suppress deformation of the endless belt by pressing force due to the interference of the protrusion and the switching guide.

2. The sheet discharge device according to claim 1, further comprising:

a first engaging member installed in the switching guide, wherein the first engaging unit engages with the switching piece so as to change the position of the switching guide from the retracting position to the distributing position.

3. The sheet discharge device according to claim 1, wherein the sheet discharge path includes a vertical conveying path which extends in a vertical direction, and the plurality of sheet discharge trays are arranged in the vertical direction with a predetermined pitch along the vertical conveying path.

4. The sheet discharge device according to claim 3, further comprising:

a general purpose tray, disposed below the lowermost sheet discharge tray out of the plurality of sheet discharge trays, and for discharging a sheet that is not discharged to any of the plurality of sheet discharge trays; and a guide plate being changed a position thereof for switching the sheet discharge destination between the general purpose tray and the sheet discharge tray by the switching mechanism.

5. The sheet discharge device according to claim 4, further comprising:

a second engaging member which is installed in the guide plate, wherein the second engaging member engages with the switching piece so as to change the position of the guide plate.

6. The sheet discharge device according to claim 1, further comprising:

a first engaging member engaging with the protrusion so as to change the position of the switching guide;

a biasing member biasing the switching guide toward the retracting position; and a guide shaft which extends in a direction perpendicular to the sheet conveying direction and integrally rotates with the switching guide about an axis center, wherein the first engaging member is secured at an edge of the guide shaft so as to rotate integrally, and interferes with the protrusion so as to change the position of the switching guide from the retracting position to the distributing position, and the interfering state of the protrusion and the first engaging member is cancelled when the protrusion passes the first engaging member by rotation of the endless belt.

7. The sheet discharge device according to claim 6, further comprising:

a control unit which controls an operation of discharging sheet, wherein the drive member is a drive motor rotating the endless belt, and the control unit includes a selection unit selecting a sheet discharge tray to which sheet is discharged, and a drive control unit which controls the rotating position of the endless belt with the drive motor so that the first engaging unit corresponding to the selected sheet discharge tray and the protrusion interfere with each other.

8. The sheet discharge device according to claim 1, further comprising:

a velocity control unit which controls the drive member to adjust the rotating velocity of the endless belt.

9. The sheet discharge device according to claim 1, further comprising:

a control unit which controls an operation of discharging sheet, the control unit including a selection unit for selecting a sheet discharge tray to which sheet is discharged, and a drive control unit for controlling the operation of the drive member so that the switching guide corresponding to the selected sheet discharge tray and the switching piece interfere with each other.

10. The sheet discharge device according to claim 1, further comprising:

a pair of sheet discharge rollers conveying sheets onto the sheet discharge tray, wherein the pair of sheet discharge rollers is driven for rotation by drive force generated by the drive member.

11. The sheet discharge device according to claim 10, wherein the transporting member is an endless belt, installed along the sheet discharge path, and rotating in one direction by the drive member, and the drive member is a drive motor rotating the endless belt, the sheet discharge device further comprising:

a pulley around which the endless belt is wound thereon and which drives the endless belt for rotation by drive force supplied from the drive motor;

a first one-way clutch installed on a rotation axis of the pulley; and a second one-way clutch installed on a rotation axis of the sheet discharge roller, wherein the endless belt is rotated by rotational driving of the pulley via the first one-way clutch when the drive motor rotates in a forward direction, and the sheet discharge roller is driven for rotation via the second one-way clutch when the drive motor rotates in a reverse direction.

12. An image forming apparatus, comprising:

an image forming unit which performs image forming processing on sheet; and a sheet discharge device discharging sheets on which an image has been formed, wherein the sheet discharge device includes:

a sheet discharge path for discharging a sheet to be discharged;

a plurality of sheet discharge trays disposed along the sheet discharge path;

a plurality of switching guides disposed in the sheet discharge path corresponding to the sheet discharge trays, and being changed a position thereof between a retracting position for being retracted so that the sheet being conveyed can pass through, and a distributing position for distributing a sheet being conveyed to the sheet discharge tray; and a switching mechanism which changes the position of the switching guide between the retracting position and the distributing position, the switching mechanism including an endless belt which is installed along the sheet discharge path and which rotates in one direction, a protrusion which protrudes from the endless belt so as to be capable of interfering with the switching guide, and a drive member which rotates the endless belt, the protrusion, interfering with the switching guide to switch the position of the switching guide, the endless belt moving the projection among the plurality of switching guides, a rotation of the endless belt stopping in a state where one switching guide out of the plurality of switching guides and the protrusion interfere with each other, whereby the position of the one switching guide is set to be the distributing position, the switching mechanism further including a first pulley around which the endless belt is wound and which drives the endless belt for rotation by drive force supplied from the drive member; and a second pulley disposed at the inner circumference side of the endless belt, the second pulley being disposed at a position to suppress deformation of the endless belt by pressing force due to the interference of the protrusion and the switching guide.

13. The image forming apparatus of claim 12, further comprising:

a first engaging member installed in the switching guide, wherein the first engaging unit engages with the switching piece so as to change the position of the switching guide from the retracting position to the distributing position.

14. The image forming apparatus of claim 12, wherein:

the sheet discharge path includes a vertical conveying path which extends in a vertical direction, and the plurality of sheet discharge trays are arranged in the vertical direction with a predetermined pitch along the vertical conveying path.

15. The image forming apparatus of claim 14, further comprising:

a general purpose tray, disposed below the lowermost sheet discharge tray out of the plurality of sheet discharge trays, and for discharging a sheet that is not discharged to any of the plurality of sheet discharge trays; and a guide plate being changed a position thereof for switching the sheet discharge destination between the general purpose tray and the sheet discharge tray by the switching mechanism.

16. The image forming apparatus of claim 15, further comprising:

a second engaging member which is installed in the guide plate, wherein the second engaging member engages with the switching piece so as to change the position of the guide plate.

17. The image forming apparatus of claim 12, further comprising:

a first engaging member engaging with the protrusion so as to change the position of the switching guide;

a biasing member biasing the switching guide toward the retracting position; and a guide shaft which extends in a direction perpendicular to the sheet conveying direction and integrally rotates with the switching guide about an axis center, wherein the first engaging member is secured at an edge of the guide shaft so as to rotate integrally, and interferes with the protrusion so as to change the position of the switching guide from the retracting position to the distributing position, and the interfering state of the protrusion and the first engaging member is cancelled when the protrusion passes the first engaging member by rotation of the endless belt.

18. The image forming apparatus of claim 17, further comprising:

a control unit which controls an operation of discharging sheet, wherein the drive member is a drive motor rotating the endless belt, and the control unit includes a selection unit selecting a sheet discharge tray to which sheet is discharged, and a drive control unit which controls the rotating position of the endless belt with the drive motor so that the first engaging unit corresponding to the selected sheet discharge tray and the protrusion interfere with each other.

19. The image forming apparatus of claim 12, further comprising:

a velocity control unit which controls the drive member to adjust the rotating velocity of the endless belt.

20. The image forming apparatus of claim 12, further comprising:

a control unit which controls an operation of discharging sheet, the control unit including a selection unit for selecting a sheet discharge tray to which sheet is discharged, and a drive control unit for controlling the operation of the drive member so that the switching guide corresponding to the selected sheet discharge tray and the switching piece interfere with each other.

* * * * *